US011081332B2

(12) United States Patent
Verenchikov

(10) Patent No.: US 11,081,332 B2
(45) Date of Patent: Aug. 3, 2021

(54) ION GUIDE WITHIN PULSED CONVERTERS

(71) Applicant: Micromass UK Limited, Wilmslow (GB)

(72) Inventor: Anatoly Verenchikov, City of Bar (ME)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/636,948

(22) PCT Filed: Jul. 26, 2018

(86) PCT No.: PCT/GB2018/052099
§ 371 (c)(1),
(2) Date: Feb. 6, 2020

(87) PCT Pub. No.: WO2019/030471
PCT Pub. Date: Feb. 14, 2019

(65) Prior Publication Data

US 2020/0168447 A1 May 28, 2020

(30) Foreign Application Priority Data

Aug. 6, 2017 (GB) ..... 1712612
Aug. 6, 2017 (GB) ..... 1712613
(Continued)

(51) Int. Cl.
*H01J 49/40* (2006.01)
*H01J 49/00* (2006.01)
(Continued)

(52) U.S. Cl.
CPC ..... *H01J 49/401* (2013.01); *H01J 49/0036* (2013.01); *H01J 49/025* (2013.01);
(Continued)

(58) Field of Classification Search
CPC .... H01J 49/401; H01J 49/0036; H01J 49/025; H01J 49/061; H01J 49/063; H01J 49/282;
(Continued)

(56) References Cited

U.S. PATENT DOCUMENTS 3,898,452 A 8/1975 Hertel
4,390,784 A 6/1983 Browning et al.
(Continued)

FOREIGN PATENT DOCUMENTS

CA 2412657 C 5/2003
CN 101369510 A 2/2009
(Continued)

OTHER PUBLICATIONS

Search Report for United Kingdom Application No. GB1613988.3 dated Jan. 5, 2017, 4 pages.
(Continued)

*Primary Examiner* — Nicole M Ippolito
(74) *Attorney, Agent, or Firm* — Kacvinsky Daisak Bluni PLLC

(57) ABSTRACT

Elongation of orthogonal accelerators is assisted by ion spatial transverse confinement within novel confinement means, formed by spatial alternation of electrostatic quadrupolar field (22). Contrary to prior art RF confinement means, the static means provide mass independent confinement and may be readily switched. Spatial confinement defines ion beam (29) position, prevents surfaces charging, assists forming wedge and bend fields, and allows axial fields in the region of pulsed ion extraction, this way improving the ion beam admission at higher energies and the spatial focusing of ion packets in multi-reflecting, multi-turn and singly reflecting TOF MS or electrostatic traps.

19 Claims, 4 Drawing Sheets

(30) Foreign Application Priority Data

Aug. 6, 2017 (GB) ..... 1712614
Aug. 6, 2017 (GB) ..... 1712616
Aug. 6, 2017 (GB) ..... 1712617
Aug. 6, 2017 (GB) ..... 1712618
Aug. 6, 2017 (GB) ..... 1712619

(51) Int. Cl.
*H01J 49/02* (2006.01)
*H01J 49/06* (2006.01)
*H01J 49/28* (2006.01)
*H01J 49/42* (2006.01)

(52) U.S. Cl.
CPC ..... *H01J 49/061* (2013.01); *H01J 49/063* (2013.01); *H01J 49/282* (2013.01); *H01J 49/403* (2013.01); *H01J 49/405* (2013.01); *H01J 49/406* (2013.01); *H01J 49/408* (2013.01); *H01J 49/4245* (2013.01)

(58) Field of Classification Search
CPC ..... H01J 49/403; H01J 49/405; H01J 49/406; H01J 49/408; H01J 49/4245
USPC ..... 250/281, 282, 283
See application file for complete search history.

(56) References Cited

U.S. PATENT DOCUMENTS 4,691,160 A 9/1987 Ino
4,731,532 A 3/1988 Frey et al.
4,855,595 A 8/1989 Blanchard
5,017,780 A 5/1991 Kutscher et al.
5,107,109 A 4/1992 Stafford, Jr. et al.
5,128,543 A 7/1992 Reed et al.
5,202,563 A 4/1993 Cotter et al.
5,331,158 A 7/1994 Dowell
5,367,162 A 11/1994 Holland et al.
5,396,065 A 3/1995 Myerholtz et al.
5,435,309 A 7/1995 Thomas et al.
5,464,985 A 11/1995 Cornish et al.
5,619,034 A 4/1997 Reed et al.
5,654,544 A 8/1997 Dresch
5,689,111 A 11/1997 Dresch et al.
5,696,375 A 12/1997 Park et al.
5,719,392 A 2/1998 Franzen
5,763,878 A 6/1998 Franzen
5,777,326 A 7/1998 Rockwood et al.
5,834,771 A 11/1998 Yoon et al.
5,955,730 A 9/1999 Kerley et al.
5,994,695 A 11/1999 Young
6,002,122 A 12/1999 Wolf
6,013,913 A 1/2000 Hanson
6,020,586 A 2/2000 Dresch et al.
6,080,985 A 6/2000 Welkie et al.
6,107,625 A 8/2000 Park
6,160,256 A 12/2000 Ishihara
6,198,096 B1 3/2001 Le Cocq
6,229,142 B1 5/2001 Bateman et al.
6,271,917 B1 8/2001 Hagler
6,300,626 B1 10/2001 Brock et al.
6,316,768 B1 11/2001 Rockwood et al.
6,337,482 B1 1/2002 Francke
6,384,410 B1 5/2002 Kawato
6,393,367 B1 5/2002 Tang et al.
6,437,325 B1 8/2002 Reilly et al.
6,455,845 B1 9/2002 Li et al.
6,469,295 B1 10/2002 Park
6,489,610 B1 12/2002 Barofsky et al.
6,504,148 B1 1/2003 Hager
6,504,150 B1 1/2003 Verentchikov et al.
6,534,764 B1 3/2003 Verentchikov et al.
6,545,268 B1 4/2003 Verentchikov et al.
6,570,152 B1 5/2003 Hoyes
6,576,895 B1 6/2003 Park
6,580,070 B2 6/2003 Cornish et al.
6,591,121 B1 7/2003 Madarasz et al.
6,614,020 B2 9/2003 Cornish
6,627,877 B1 9/2003 Davis et al.
6,646,252 B1 11/2003 Gonin
6,647,347 B1 11/2003 Roushall et al.
6,664,545 B2 12/2003 Kimmel et al.
6,683,299 B2 1/2004 Fuhrer et al.
6,694,284 B1 2/2004 Nikoonahad et al.
6,717,132 B2 4/2004 Franzen
6,734,968 B1 5/2004 Wang et al.
6,737,642 B2 5/2004 Syage et al.
6,744,040 B2 6/2004 Park
6,744,042 B2 6/2004 Zajfman et al.
6,747,271 B2 6/2004 Gonin et al.
6,770,870 B2 8/2004 Vestal
6,782,342 B2 8/2004 LeGore et al.
6,787,760 B2 9/2004 Belov et al.
6,794,643 B2 9/2004 Russ, IV et al.
6,804,003 B1 10/2004 Wang et al.
6,815,673 B2 11/2004 Plomley et al.
6,833,544 B1 12/2004 Campbell et al.
6,836,742 B2 12/2004 Brekenfeld
6,841,936 B2 1/2005 Keller et al.
6,861,645 B2 3/2005 Franzen
6,864,479 B1 3/2005 Davis et al.
6,870,156 B2 3/2005 Rather
6,870,157 B1 3/2005 Zare
6,872,938 B2 3/2005 Makarov et al.
6,888,130 B1 5/2005 Gonin
6,900,431 B2 5/2005 Belov et al.
6,906,320 B2 6/2005 Sachs et al.
6,940,066 B2 9/2005 Makarov et al.
6,949,736 B2 9/2005 Ishihara
7,034,292 B1 4/2006 Whitehouse et al.
7,071,464 B2 7/2006 Reinhold
7,084,393 B2 8/2006 Fuhrer et al.
7,091,479 B2 8/2006 Hayek
7,126,114 B2 10/2006 Chernushevich
7,196,324 B2 3/2007 Verentchikov
7,217,919 B2 5/2007 Boyle et al.
7,221,251 B2 5/2007 Menegoli et al.
7,326,925 B2 2/2008 Verentchikov et al.
7,351,958 B2 4/2008 Vestal
7,365,313 B2 4/2008 Fuhrer et al.
7,385,187 B2 6/2008 Verentchikov et al.
7,388,197 B2 6/2008 McLean et al.
7,399,957 B2 7/2008 Parker et al.
7,423,259 B2 9/2008 Hidalgo et al.
7,498,569 B2 3/2009 Ding
7,501,621 B2 3/2009 Willis et al.
7,504,620 B2 3/2009 Sato et al.
7,521,671 B2 4/2009 Kirihara et al.
7,541,576 B2 6/2009 Belov et al.
7,582,864 B2 9/2009 Verentchikov
7,608,817 B2 10/2009 Flory
7,663,100 B2 2/2010 Vestal
7,675,031 B2 3/2010 Konicek et al.
7,709,789 B2 5/2010 Vestal et al.
7,728,289 B2 6/2010 Naya et al.
7,745,780 B2 6/2010 McLean et al.
7,755,036 B2 7/2010 Satoh
7,772,547 B2 8/2010 Verentchikov
7,800,054 B2 9/2010 Fuhrer et al.
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,985,950 B2 7/2011 Makarov et al.
7,989,759 B2 8/2011 Holle
7,999,223 B2 8/2011 Makarov et al.
8,017,907 B2 9/2011 Willis et al.
8,017,909 B2 9/2011 Makarov et al.
8,063,360 B2 11/2011 Willis et al.
8,080,782 B2 12/2011 Hidalgo et al.
8,093,554 B2 1/2012 Makarov
8,237,111 B2 8/2012 Golikov et al.

(56) References Cited

U.S. PATENT DOCUMENTS 8,354,634 B2 1/2013 Green et al.
8,395,115 B2 3/2013 Makarov et al.
8,492,710 B2 7/2013 Fuhrer et al.
8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.
8,723,108 B1 5/2014 Ugarov
8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov
9,099,287 B2 8/2015 Giannakopulos
9,136,101 B2 9/2015 Grinfeld et al.
9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Noyes et al.
9,281,175 B2 3/2016 Haulier et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 10/2017 Verenchikov
9,786,484 B2 10/2017 Willis et al.
9,786,485 B2 10/2017 Ding et al.
9,865,441 B2 1/2018 Damoc et al.
9,865,445 B2 1/2018 Verenchikov et al.
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Noyes et al.
10,622,203 B2 4/2020 Veryovkin et al.
10,629,425 B2 4/2020 Hoyes et al.
10,636,646 B2 4/2020 Hoyes et al.
2001/0011703 A1 8/2001 Franzen
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li
2003/0010907 A1 1/2003 Hayek et al.
2003/0111597 A1 6/2003 Gonin et al.
2003/0232445 A1 12/2003 Fulghum
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1* 7/2005 Brown ..... H01J 49/421 250/290
2005/0194528 A1 9/2005 Yamaguchi et al.
2005/0242279 A1 11/2005 Verentchikov
2005/0258364 A1 11/2005 Whitehouse et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0206250 A1 8/2009 Wollnik
2009/0250607 A1 10/2009 Staats et al.
2009/0272890 A1 11/2009 Ogawa et al.
2010/0001180 A1 1/2010 Bateman et al.
2010/0044558 A1 2/2010 Sudakov
2010/0072363 A1 3/2010 Giles et al.
2010/0078551 A1 4/2010 Loboda
2010/0140469 A1 6/2010 Nishiguchi
2010/0193682 A1 8/2010 Golikov et al.
2010/0207023 A1 8/2010 Loboda
2010/0301202 A1 12/2010 Vestal
2011/0133073 A1 6/2011 Sato et al.
2011/0168880 A1 7/2011 Ristroph et al.
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2013/0048852 A1 2/2013 Verenchikov
2013/0056627 A1 3/2013 Verenchikov
2013/0068942 A1 3/2013 Verenchikov
2013/0187044 A1 7/2013 Ding et al.
2013/0240725 A1 9/2013 Makarov
2013/0248702 A1 9/2013 Makarov
2013/0256524 A1 10/2013 Brown et al.
2013/0313424 A1 11/2013 Makarov et al.
2013/0327935 A1 12/2013 Wiedenbeck
2014/0054456 A1 2/2014 Kinugawa et al.
2014/0084156 A1 3/2014 Ristroph et al.
2014/0117226 A1 5/2014 Giannakopulos
2014/0138538 A1 5/2014 Hieftje et al.
2014/0183354 A1 7/2014 Moon et al.
2014/0191123 A1* 7/2014 Wildgoose ..... H01J 49/161 250/282
2014/0239172 A1 8/2014 Makarov
2014/0291503 A1 10/2014 Shchepunov et al.
2014/0312221 A1 10/2014 Verenchikov et al.
2014/0361162 A1 12/2014 Murray et al.
2015/0028197 A1 1/2015 Grinfeld et al.
2015/0028198 A1 1/2015 Grinfeld et al.

(56) References Cited

U.S. PATENT DOCUMENTS

| | | | | |
|---|---|---|---|---|
| 2015/0034814 | A1* | 2/2015 | Brown | H01J 49/40 250/282 |
| 2015/0048245 | A1 | 2/2015 | Vestal et al. | |
| 2015/0060656 | A1 | 3/2015 | Ugarov | |
| 2015/0122986 | A1 | 5/2015 | Haase | |
| 2015/0194296 | A1 | 7/2015 | Verenchikov et al. | |
| 2015/0228467 | A1 | 8/2015 | Grinfeld et al. | |
| 2015/0279650 | A1 | 10/2015 | Verenchikov | |
| 2015/0294849 | A1 | 10/2015 | Makarov et al. | |
| 2015/0318156 | A1 | 11/2015 | Loyd et al. | |
| 2015/0364309 | A1* | 12/2015 | Welkie | H01J 49/40 250/282 |
| 2015/0380233 | A1 | 12/2015 | Verenchikov | |
| 2016/0005587 | A1 | 1/2016 | Verenchikov | |
| 2016/0035558 | A1 | 2/2016 | Verenchikov et al. | |
| 2016/0079052 | A1 | 3/2016 | Makarov | |
| 2016/0024036 | A1 | 8/2016 | Verenchikov | |
| 2016/0225598 | A1 | 8/2016 | Ristroph | |
| 2016/0225602 | A1 | 8/2016 | Ristroph et al. | |
| 2016/0240363 | A1 | 8/2016 | Verenchikov | |
| 2017/0016863 | A1 | 1/2017 | Verenchikov | |
| 2017/0025265 | A1 | 1/2017 | Verenchikov et al. | |
| 2017/0032952 | A1 | 2/2017 | Verenchikov | |
| 2017/0098533 | A1 | 4/2017 | Stewart et al. | |
| 2017/0229297 | A1 | 8/2017 | Green et al. | |
| 2017/0338094 | A1 | 11/2017 | Verenchikov et al. | |
| 2018/0144921 | A1 | 5/2018 | Hoyes et al. | |
| 2018/0315589 | A1 | 11/2018 | Oshiro | |
| 2018/0366312 | A1 | 12/2018 | Hamish et al. | |
| 2019/0237318 | A1 | 8/2019 | Brown | |
| 2020/0083034 | A1 | 3/2020 | Hoyes et al. | |
| 2020/0126781 | A1 | 4/2020 | Kovtoun | |
| 2020/0152440 | A1 | 5/2020 | Hoyes et al. | |
| 2020/0168447 | A1 | 5/2020 | Verenchikov | |
| 2020/0168448 | A1 | 5/2020 | Verenchikov et al. | |

FOREIGN PATENT DOCUMENTS

| | | | |
|---|---|---|---|
| CN | 102131563 | A | 7/2011 |
| CN | 201946564 | U | 8/2011 |
| DE | 4310106 | C1 | 10/1994 |
| DE | 10116536 | A | 10/2002 |
| DE | 10116536 | A1 | 10/2002 |
| DE | 102015121830 | A1 | 6/2017 |
| DE | 102019129108 | A1 | 6/2020 |
| DE | 112015001542 | B4 | 7/2020 |
| EP | 0237259 | A2 | 9/1987 |
| EP | 1137044 | A2 | 9/2001 |
| EP | 1566828 | A2 | 8/2005 |
| EP | 1901332 | A1 | 3/2008 |
| EP | 2068346 | A2 | 6/2009 |
| EP | 1665326 | B1 | 4/2010 |
| EP | 1789987 | A4 | 9/2010 |
| EP | 1522087 | B1 | 3/2011 |
| EP | 2599104 | A1 | 6/2013 |
| EP | 1743354 | B1 | 8/2019 |
| EP | 3662501 | A1 | 6/2020 |
| EP | 3662502 | A1 | 6/2020 |
| EP | 3662503 | A1 | 6/2020 |
| GB | 2080021 | A | 1/1982 |
| GB | 2217907 | A | 11/1989 |
| GB | 2300296 | A | 10/1996 |
| GB | 2390935 | A | 1/2004 |
| GB | 2396742 | A | 6/2004 |
| GB | 2403063 | A | 12/2004 |
| GB | 2455977 | A | 7/2009 |
| GB | 2476964 | A | 7/2011 |
| GB | 2478300 | A | 9/2011 |
| GB | 2484361 | B | 4/2012 |
| GB | 2484429 | B | 4/2012 |
| GB | 2485825 | A | 5/2012 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2500743 | A | 10/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| GB | 2556830 | A | 6/2018 |
| GB | 2562990 | A | 12/2018 |
| GB | 2575157 | A | 1/2020 |
| GB | 2575339 | A | 1/2020 |
| JP | S6229049 | A | 2/1987 |
| JP | 2000036285 | A | 2/2000 |
| JP | 2000048764 | A | 2/2000 |
| JP | 2003031178 | A | 1/2003 |
| JP | 3571546 | B2 | 9/2004 |
| JP | 2005538346 | A | 12/2005 |
| JP | 2006049273 | A | 2/2006 |
| JP | 2007227042 | A | 9/2007 |
| JP | 2010062152 | A | 3/2010 |
| JP | 4649234 | B2 | 3/2011 |
| JP | 2011119279 | A | 6/2011 |
| JP | 4806214 | B2 | 11/2011 |
| JP | 2013539590 | A | 10/2013 |
| JP | 5555582 | B2 | 7/2014 |
| JP | 2015506567 | A | 3/2015 |
| JP | 2015185306 | A | 10/2015 |
| RU | 2564443 | C2 | 10/2015 |
| RU | 2564443 | C2 | 5/2017 |
| RU | 2015148627 | A | 5/2017 |
| RU | 2660655 | C2 | 7/2018 |
| SU | 198034 | A1 | 6/1967 |
| SU | 1681340 | A1 | 9/1991 |
| SU | 1725289 | A1 | 4/1992 |
| WO | 9103071 | A1 | 3/1991 |
| WO | 13045428 | A1 | 4/1992 |
| WO | 98001218 | A1 | 1/1998 |
| WO | 1998001218 | A1 | 1/1998 |
| WO | 0077823 | A2 | 12/2000 |
| WO | 200077823 | A2 | 12/2000 |
| WO | 2005001878 | A2 | 1/2005 |
| WO | 2006049623 | A2 | 5/2006 |
| WO | 2006102430 | A2 | 9/2006 |
| WO | 2006103448 | A2 | 10/2006 |
| WO | 2007044696 | A1 | 4/2007 |
| WO | 2007104992 | A2 | 9/2007 |
| WO | 2007136373 | A1 | 11/2007 |
| WO | 2008046594 | A2 | 4/2008 |
| WO | 2008087389 | A2 | 7/2008 |
| WO | 2010008386 | A1 | 1/2010 |
| WO | 2010138781 | A2 | 12/2010 |
| WO | 2011086430 | A1 | 7/2011 |
| WO | 2011107836 | A1 | 9/2011 |
| WO | 2011135477 | A1 | 11/2011 |
| WO | 2012010894 | A1 | 1/2012 |
| WO | 2012023031 | A2 | 2/2012 |
| WO | 2012024468 | A2 | 2/2012 |
| WO | 2012024570 | A2 | 2/2012 |
| WO | 2012116765 | A1 | 9/2012 |
| WO | 2013045428 | A1 | 4/2013 |
| WO | 13063587 | A2 | 5/2013 |
| WO | 2013063587 | A2 | 5/2013 |
| WO | 2013067366 | A2 | 5/2013 |
| WO | 13093587 | A1 | 6/2013 |
| WO | 2013093587 | A1 | 6/2013 |
| WO | 2013098612 | A1 | 7/2013 |
| WO | 13110587 | A2 | 8/2013 |
| WO | 13124207 | A1 | 8/2013 |
| WO | 2013110587 | A2 | 8/2013 |
| WO | 2013110588 | A2 | 8/2013 |
| WO | 2013124207 | A | 8/2013 |
| WO | 2014021960 | A1 | 2/2014 |
| WO | 2014074822 | A1 | 5/2014 |
| WO | 14110697 | A1 | 7/2014 |
| WO | 1998008244 | A2 | 7/2014 |
| WO | 2014110697 | A1 | 7/2014 |
| WO | 2014142897 | A1 | 9/2014 |

(56) References Cited

FOREIGN PATENT DOCUMENTS

| | | | |
|---|---|---|---|
| WO | 2015142897 | A1 | 9/2015 |
| WO | 2015152968 | A1 | 10/2015 |
| WO | 2015153622 | A1 | 10/2015 |
| WO | 2015153630 | A1 | 10/2015 |
| WO | 2015153644 | A1 | 10/2015 |
| WO | 2015175988 | A1 | 11/2015 |
| WO | 2016064398 | A1 | 4/2016 |
| WO | 2016174462 | A1 | 11/2016 |
| WO | 2017042665 | A1 | 3/2017 |
| WO | 2018073589 | A1 | 4/2018 |
| WO | 2018109920 | A1 | 6/2018 |
| WO | 2018124861 | A2 | 7/2018 |
| WO | 2019030474 | A1 | 2/2019 |
| WO | 2019030475 | A1 | 2/2019 |
| WO | 2019030476 | A1 | 2/2019 |
| WO | 2019030477 | A1 | 2/2019 |
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |
| WO | 2020021255 | A1 | 1/2020 |
| WO | 2020121167 | A1 | 6/2020 |
| WO | 2020121168 | A1 | 6/2020 |

OTHER PUBLICATIONS

Sakurai et al., "A New Multi-Passage Time-of-Flight Mass Spectrometer at JAIST", Nuclear Instruments Methods in Physics Research, Section A, Elsevier, 427(1-2): 182-186, May 11, 1999.

Toyoda et al., "Multi-Turn-Time-of-Flight Mass Spectometers with Electrostatic Sectors", Journal of Mass Spectrometry, 38: 1125-1142, Jan. 1, 2003.

Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.

Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Internet: URL:https://www.etp-ms.com/file-repository/21 [retrieved on Jul. 31, 2019].

Kaufmann, R., et. al., "Sequencing of peptides in a time-of-flight mass spectrometer: evaluation of postsource decay following matrix-assisted laser desorption ionisation (MALDI)", International Journal of Mass Spectrometry and Ion Processes, Elsevier Scientific Publishing Co. Amsterdam, NL, 131:355-385, Feb. 24, 1994.

Barry Shaulis et al: "Signal linearity of an extended range pulse counting detector: Applications to accurate and precise U—Pb dating of zircon by laser ablation quadrupole ICP-MS", G3: Geochemistry, Geophysics, Geosystems, 11(11):1-12, Nov. 20, 2010.

Search Report for United Kingdom Application No. GB1708430.2 dated Nov. 28, 2017.

International Search Report and Written Opinion for International Application No. PCT/GB2018/051320 dated Aug. 1, 2018.

International Search Report and Written Opinion for International Application No. PCT/GB2019/051839 dated Sep. 18, 2019.

International Search Report and Written Opinion for International Application No. PCT/GB2019/051234 dated Jul. 29, 2019.

Extended European Search Report for EP Patent Application No. 16866997.6, dated Oct. 16, 2019.

Search Report under Section 17(5) for GB1916445.8, dated Jun. 15, 2020.

International Search Report and Written Opinion for International Application No. PCT/GB20180051320 dated Aug. 1, 2018.

Stresau, D., et al., "Ion Counting Beyond 10ghz Using a New Detector and Conventional Electronics", European Winter Conference on Plasma Spectrochemistry, Feb. 4-8, 2001, Lillehammer, Norway, Retrieved from the Internet URL https://www.etp-ms.com/file-repository/21 [retrieved on Jul. 31, 2019].

Shaulis, Barry, et al., "Signal linearity of an extended range pulse counting detector: Applications to accurate and precise U—Pb dating of zircon by laser ablation quadrupole ICP-MS", G3: Geochemistry, Geophysics, Geosystems, 11(11):1-12, Nov. 20, 2010.

Sakurai, T, et al., "A new multi-passage time-of-flight mass spectrometer at JAIST", Nuclear Instruments and Methods in Physics Research A: Accelerators, Spectrometers, Detectors and Associated Equipment, 427(1-2):182-186 (1999).

International Search Report and Written Opinion for International Application No. PCT/US2016/062174 dated Mar. 5, 2017, 8 pages.

IPRP PCT/US2016/062174 issued May 22, 2018, 6 pages.

Search Report for GB Application No. GB1520130.4 dated May 25, 2016.

International Search Report and Written Opinion for International Application No. PCT/US2016/062203 dated Mar. 6, 2017, 8 pages.

Search Report for GB Application No. GB1520134.6 dated May 26, 2016.

IPRP PCT/US2016/062203, issued May 22, 2018, 6 pages.

Search Report Under Section 17(5) for Application No. GB1507363.8 dated Nov. 9, 2015.

International Search Report and Written Opinion of the International Search Authority for Application No. PCT/GB2016/051238 dated Jul. 12, 2016, 16 pages.

IPRP for application PCT/GB2016/051238 dated Oct. 31, 2017, 13 pages.

International Search Report and Written Opinion for International Application No. PCT/US2016/063076 dated Mar. 30, 2017, 9 pages.

Search Report for GB Application No. 1520540.4 dated May 24, 2016.

IPRP for application PCT/US2016/063076, dated May 29, 2018, 7 pages.

IPRP PCT/GB17151981 dated Jan. 8, 2019, 7 pages.

International Search Report and Written Opinion for International Application No. PCT/GB2018/051206, dated Jul. 12, 2018, 9 pages.

Author unknown, "Electrostatic lens," Wikipedia, Mar. 31, 2017 (Mar. 31, 2017), XP055518392, Retrieved from the Intemet URL https://en.wikipedia.org/w/index.phptitle=Electrostaticlens oldid=773161674[retrieved on Oct. 24, 2018].

Hussein, O.A. et al., "Study the most favorable shapes of electrostatic quadrupole doublet lenses", AIP Conference Proceedings, vol. 1815, Feb. 17, 2017 (Feb. 17, 2017), p. 110003.

Guan S., et al., "Stacked-ring electrostatic ion guide", Journal of the American Society for Mass Spectrometry, Elsevier Science Inc, 7(1)101-106 (1996).

Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.

International Search Report and Written Opinion for application No. PCT/GB2018/052104, dated Oct. 31, 2018, 14 pages.

International Search Report and Written Opinion for application No. PCT/GB2018/052105, dated Oct. 15, 2018, 18 pages.

International Search Report and Written Opinion for application PCT/GB2018/052100, dated Oct. 19, 2018, 19 pages.

International Search Report and Written Opinion for application PCT/GB2018/052102, dated Oct. 25, 2018, 14 pages.

International Search Report and Written Opinion for application No. PCT/GB2018/052099, dated Oct. 10, 2018, 16 pages.

International Search Report and Written Opinion for application No. PCT/GB2018/052101, dated Oct. 19, 2018, 15 pages.

Combined Search and Examination Report under Sections 17 and 18(3) for application GB1807605.9, dated Oct. 29, 2018, 6 pages.

Combined Search and Examination Report under Sections 17 and 18(3) for application GB1807626.5, dated Oct. 29, 2018, 8 pages.

Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.

Search Report under Section 17(5) for application GB1707208.3, dated Oct. 12. 2017, 6 pages.

(56) References Cited

OTHER PUBLICATIONS

Communication Relating to the Results of the Partial International Search for International Application No. PCT/GB2019/01118, dated Jul. 19, 2019, 25 pages.
Doroshenko, V.M., and Cotter, R.J., "Ideal velocity focusing in a reflectron time-of-flight mass spectrometer", American Society for Mass Spectrometry, 10(10):992-999 (1999).
Kozlov, B. et al. "Enhanced Mass Accuracy in Multi-Reflecting TOF MS" www.waters.com/posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov, A. N. "Parallel MS-MS Analysis in a Time-Flight Tandem. Problem Statement, Method, and Instrumental Schemes" Institute for Analytical Instrumentation RAS, Saint-Petersburg, (2004).
Yavor, M. I. "Planar Multireflection Time-Of-Flight Mass Analyzer with Unlimited Mass Range" Institute for Analytical Instrumentation RAS, Saint-Petersburg, (2004).
Khasin, Y. I. et al., "Initial Experimental Studies of a Planar Multireflection Time-Of-Flight Mass Spectrometer" Institute for Analytical Instrumentation RAS, Saint-Petersburg, (2004).
Verenchicov, A. N. et al. "Stability of Ion Motion in Periodic Electrostatic Fields" Institute for Analytical Instrumentation RAS, Saint-Petersburg, (2004).
Verenchicov, A. N. "The Concept of Multireflecting Mass Spectrometer for Continuous Ion Sources" Institute for Analytical Instrumentation RAS, Saint-Petersburg, (2006).
Verenchicov, A. N., et al. "Accurate Mass Measurements for Interpreting Spectra of atmospheric Pressure Ionization" Institute for Analytical Instrumentation RAS, Saint-Petersburg, (2006).
Kozlov, B. N. et al., "Experimental Studies of Space Charge Effects in Multireflecting Time-Of-Flight Mass Spectrometes" Institute for Analytical Instrumentation RAS, Saint-Petersburg, (2006).
Kozlov, B. N. et al., "Multireflecting Time-Of-Flight Mass Spectrometer With an Ion Trap Source" Institute for Analytical Instrumentation RAS, Saint-Petersburg, (2006).
Hasin, Y. I., et al., "Planar Time-Of-Flight Multireflecting Mass Spectrometer with an Orthogonal Ion Injection Out of Continuous Ion Sources" Institute for Analytical Instrumentation RAS, Saint-Petersburg, (2006).
Lutvinsky, Y. I., et al., "Estimation of Capacity of High Resolution Mass Spectra for Analysis of Complex Mixtures" Institute for Analytical Instrumentation RAS, Saint-Petersburg, (2006).
International Search Report and Written Opinion for International appliication No. PCT/GB2020/050209, dated Apr. 28, 2020, 12 pages.
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.
Supplementary Partial EP Search Report for EP Application No. 16866997.6, dated Jun. 7, 2019.
Wikipedia "Reflectron", Oct. 9, 2015, Retrieved from the Internet URL https://en.wikipedia.org/w/index.php?title=Reflectron&oldid=684843442 [retrieved on May 29, 2019].
Toyoda, M. et al., "Multi-turn time-of-flight mass spectrometers with electrostatic sectors," Journal of Mass Spectrometry, 38:1125-1142 (2003).
International Search Report and Written Opinion for International Application No. PCT/US2016/062174 dated Mar. 6, 2017, 8 pages.
IPRP PCT/GB17/51981 dated Jan. 8, 2019, 7 pages.
N/a: "Electrostatic lens ," Wikipedia, Mar. 31, 2017 (Mar. 31, 2017), XP055518392, Retrieved from the Intemet:URL: https://en.wikipedia.org/w/index.phptitle=Electrostatic lens oldid=773161674[retrieved on Oct. 24, 2018].
Combined Search and Examination Report under Sections 17 and 18(3) for application GB1807605.9 dated Oct. 29, 2018, 5 pages.
Combined Search and Examination Report under Sections 17 and 18(3) for application GB1807626.5, dated Oct. 29, 2018, 7 pages.
Search Report under Section 17(5) for application GB1707208.3, dated Oct. 12, 2017, 5 pages.
Verenchicov., A. N. "Parallel MS-MS Analysis in a Time-Flight Tandem. Problem Statement, Method, and Instrucmental Schemes" Institute for Analytical Instrucmentation RAS, Saint-Petersburg, (2004).
Yavor, M. I. "Planar Multireflection Time-Of-Flight Mass Analyser with Unlimited Mass Range" Institute for Analytical nstrucmentation RAS, Saint-Petersburg, (2004).
Khasin, Y. I. et al. "Initial Experimenatl Studies of a Planar Multireflection Time-Of-Flight Mass Spectrometer" Institute for Analytical Instrucmentation RAS, Saint-Petersburg, (2004).
Verenchicov., A. N. et al. "Stability of Ion Motion in Periodic Electrostatic Fields" Institute for Analytical Instrucmentation RAS, Saint-Petersburg, (2004).
Verenchicov., A. N. "The Concept of Mutireflecting Mass Spectrometer for Continuous Ion Sources" Institute for Analytical Instrumentation RAS, Saint-Petersburg, (2006).
Verenchicov., A. N., et al. "Accurate Mass Measurements for Inerpreting Spectra of atmospheric Pressure Ionization" Institute for Analytical Instrumentation RAS, Saint-Petersburg, (2006).
Kozlov, B. N. et al., "Experimental Studies of Space Charge Effects in Multireflecting Time-Of-Flight Mass Spectrometes" Institute for Analytical Instrucmentation RAS, Saint-Petersburg, (2006).
Kozlov, B. N. et al., "Multireflecting Time-Of-Flight Mass Spectrometer With an Ion Trap Source" Institute for Analytical Instrucmentation RAS, Saint-Petersburg, (2006).
Hasin, Y. I., et al., "Planar Time-Of-Flight Multireflecting Mass Spectrometer with an Orthogonal Ion Injection Out of Continuous Ion Sources" Institute for Analytical Instrucmentation RAS, Saint-Petersburg, (2006).
Lutvinsky Y. I. et al., "Estimation of Capacity of High Resolution Mass Spectra for Analysis of Complex Mixtures" Institute for Analytical Instrucmentation RAS, Saint-Petersburg, (2006).
International Search Report and Written Opinion for International application No. PCT/GB2020/050209, dated Apr. 28, 2020, 12 pages.
Reflectron—Wikipedia, Oct. 9, 2015, Retrieved from the Internet URL:https://en.wikipedia.org/w/index.phptitle=Reflectron oldid=684843442 [retrieved on May 29, 2019].
International Search Report and Written Opinion for International Application No. PCT/EP2017/070508 dated Oct. 16, 2017, 17 pages.
"Einzel Lens", Wikipedia, https://en.wikipedia.org/wiki/Einzel_lens (Year: 2020).
International Search Report and Written Opinion for International application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB1906258.7, dated Dec. 11, 2020, 7 pages.
Carey, D.C., "Why a second-order magnetic optical achromat works", Nucl. Instrum. Meth., 189(203):365-367 (1981). Abstract.
Sakurai, T. et al., "Ion optics for time-of-flight mass spectrometers with multiple symmetry", Int J Mass Spectrom Ion Proc 63(2-3):273-287 (1985). Abstract.
Wollnik, H., and Casares, A., "An energy-isochronous multi-pass time-of-flight mass spectrometer consisting of two coaxial electrostatic mirrors", Int J Mass Spectrom 227:217-222 (2003). Abstract.
Examination Report under Section 18(3) for Application No. GB1906258.7, dated May 5, 2021, 4 pages.

* cited by examiner

ION GUIDE WITHIN PULSED CONVERTERS

CROSS-REFERENCE TO RELATED APPLICATION APPLICATIONS

This application is a national phase filing claiming the benefit of and priority to International Patent Application No. PCT/GB2018/052099, filed on Jul. 26, 2018, which claims priority from and the benefit of United Kingdom patent application No. 1712612.9, United Kingdom patent application No. 1712613.7, United Kingdom patent application No. 1712614.5, United Kingdom patent application No. 1712616.0, United Kingdom patent application No. 1712617.8, United Kingdom patent application No. 1712618.6 and United Kingdom patent application No. 1712619.4, each of which was filed on Aug. 6, 2017. The entire content of these applications is incorporated herein by reference.

FIELD OF INVENTION

The invention relates to the area of time of flight and electrostatic trap mass spectrometers and is particularly concerned with pulsed converters.

BACKGROUND

Time-of-flight mass spectrometers (TOF MS) are widely used for combination of sensitivity and speed, and lately with the introduction of ion mirrors and multi-reflecting schemes, for their high resolution and mass accuracy.

In last two decades, the resolution of TOF MS has been substantially improved by using multi-pass TOFMS (MPTOF), employing either ion mirrors for multiple ion reflections in a multi-reflecting TOFMS (MRTOF), e.g. as described in SU1725289, U.S. Pat. Nos. 6,107,625, 6,570,152, GB2403063, U.S. Pat. No. 6,717,132, or employing electrostatic sectors for multiple ion turns in a multi-turn TOFMS (MTTOF) as described in U.S. Pat. Nos. 7,504,620, 7,755,036, and M. Toyoda, et. al, J. Mass Spectrom. 38 (2003) 1125, incorporated herein by reference. The term "pass" generalizes ion mirror reflection in MRTOF and ion turn in MTTOF.

Electrostatic traps (E-traps) with image current detection is an emerging technology. With success of compact Orbitrap electrostatic analyzers, alternative approaches were proposed for higher space charge capacity and throughput of E-traps. Historically ion traps were used for accumulation and pulsed ejection of large size ion clouds into E-traps. However, elongated pulsed converters are equally feasible. Open traps is another intermediate hybrid of TOF MS and E-trap.

Operation of TOF MS starts with pulsed injection of ion packets. Pulsed sources are used for intrinsically pulsed ionization methods, such as Matrix Assisted Laser Desorption and Ionization (MALDI), Secondary Ionization (SIMS), and pulsed EI. The first two ion sources become more and more popular for mass spectral surface imaging, where relatively large surface area is analyzed simultaneously while using mapping properties of TOF MS.

Even more popular are TOF MS, where pulsed converters are used to form pulsed ion packets out of continuous ion beams produced by ion sources like Electron Impact (EI), Electrospray (ESI), Atmospheric pressure ionization (APPI), atmospheric Pressure Chemical Ionization (APCI), Inductively couple Plasma (ICP) and gaseous (MALDI). Most common pulsed converters are orthogonal accelerators as exampled in WO9103071, and radiofrequency ion traps with pulsed radial ejection, lately used for ion injection into Orbitraps.

Elongated orthogonal accelerators have been recently proposed in WO2016174462 and co-pending application by the inventor for higher duty cycle and sensitivity. This raises a question of ion beam retaining in the elongated OA. U.S. Pat. No. 5,763,878 or 8,373,120 propose using RF fields for transverse ion confinement, which limits the retained mass range and produces multiple mass dependent and RF phase dependent effects at ion pulsed ejection. RU2013149761 proposed using static quadrupolar field for moderate elongation of OA, which allows moderate elongation of the OA, since the quadrupole field defocuses the ion beam in the second direction.

SUMMARY

From a first aspect the present invention provides a pulsed ion accelerator for a mass spectrometer comprising: an ion guide portion having electrodes arranged to receive ions travelling along a first direction (Z-dimension), including a plurality of DC electrodes spaced along the first direction; DC voltage supplies configured to apply different DC potentials to different ones of said DC electrodes such that when ions travel through the ion guide portion along the first direction they experience an ion confining force, generated by the DC potentials, in at least one dimension (X- or Y-dimension) orthogonal to the first direction; and a pulsed voltage supply configured to apply a pulsed voltage to at least one electrode of the ion accelerator for pulsing ions out of the ion accelerator in a second direction (X-dimension) substantially orthogonal to the first direction (Z-dimension).

The DC electrodes and DC voltage supplies generate an electrostatic field that spatially varies along the first direction. As such, the ions travelling along the first direction experience different forces at different distances along the first direction. This enables the ions to be confined by the DC potentials in an effective potential well that may be independent of the mass to charge ratios of the ions.

The ion confining force generated by the DC potentials desirably confines ions in the second dimension (X-dimension). This may improve the initial spatial distribution of the ions for pulsing in the second dimension (X-dimension).

The DC voltage supplies may be configured to apply different DC potentials to different ones of said DC electrodes such that when ions travel through the ion guide portion along the first direction they experience an ion confining force generated by the DC potentials in both dimensions (X- and Y-dimensions) orthogonal to the first direction.

Embodiments of the ion guide portion enable the pulsed ion accelerator to be relatively long in the first direction, whilst having relatively low ion losses, ion beam spreading and surface charging of the electrodes of the ion accelerator.

The ion confinement may be performed without the use of resonant RF circuits, and can be readily switched on and off. More specifically, the use of DC potentials to confine the ions in the ion guide portion enables embodiments to switch off the confining potentials relatively quickly (as opposed to RF confinement voltages), e.g. just before the pulsed ion ejection. Also, the pulsed voltage for ejecting ions does not excite the DC ion confinement electrodes in the detrimental manner that it would with RF confinement electrodes.

The provision of the DC electrodes spaced along the first direction enables the strength and shape of the DC confining field to be set up to vary along the first direction of the ion guide portion, e.g. to provide an axial gradient, a slight wedge or curvature of the confining field, without constructing complex RF circuits.

The pulsed ion accelerator may be an orthogonal accelerator.

The ions may enter into the pulsed ion accelerator along the first direction.

The ion guide portion may comprise a first pair of opposing rows of said DC electrodes on opposing sides of the ion guide portion, wherein each row extends in the first direction (Z-dimension).

The rows may be spaced apart in a third direction (Y-dimension), that is orthogonal to the first and second directions, by a gap. The pulsed ion accelerator may be configured such that when the pulsed voltage is applied to the at least one electrode, the ions are pulsed in the second direction (X-dimension) through the gap between the rows of electrodes and out of the ion guide portion. The ions may therefore be pulsed out of the ion guide without impacting on the rows of electrodes.

The DC voltage supplies may be configured to maintain at least some of the adjacent DC electrodes in each row at potentials having opposite polarities.

Each electrode in a given row may be maintained at an opposite polarity to the opposing electrode in the other row, i.e. each electrode in a given row may be maintained at an opposite polarity to the electrode having the same location (in the first direction) in the opposing row.

The ion guide portion may comprise a second pair of opposing rows of said DC electrodes on opposing sides of the ion guide portion, wherein each row extends in the first direction (Z-dimension). These rows may be spaced apart in the third direction (Y-dimension), that is orthogonal to the first and second directions, by a gap. The DC voltage supplies maybe configured to maintain at least some of the adjacent DC electrodes in each row at potentials having opposite polarities.

Each electrode in a given row of the second pair may be maintained at an opposite polarity to the opposing electrode in the other row of the second pair, i.e. each electrode in a given row of the second pair may be maintained at an opposite polarity to the electrode having the same location (in the first direction) in the opposing row of the second pair.

Ions may be received in the ion guide portion in the region radially inward of (and defined by) the first and second pairs of rows.

The DC voltage supplies may be configured to maintain the DC electrodes at potentials so as to form an electrostatic quadrupolar field in the plane orthogonal to the first direction, wherein the polarity of the quadrupolar field alternates as a function of distance along the first direction.

The DC electrodes may be arranged to form a quadrupole ion guide that is axially segmented in the first direction, and wherein the DC voltage supplies are configured to maintain DC electrodes that are axially adjacent in the first direction at opposite polarities, and DC electrodes that are adjacent in a direction orthogonal to the first direction at opposite polarities.

The DC quadrupolar field may spatially oscillate in the first direction.

The DC electrodes may have the same lengths in the first direction and may be periodically spaced along the first direction.

The DC electrodes may be arranged on one or more printed circuit board (PCB), insulating substrate, or insulating film.

For example, each of the rows of DC electrodes may be arranged on a respective printed circuit board, insulating substrate, or insulating film. Alternatively, two of the rows of DC electrodes may be arranged on two opposing sides of a PCB, insulating substrate, or insulating film. Alternatively, two of the rows of DC electrodes may be arranged on different layers of a multi-layer PCB or insulating substrate.

The PCB(s), insulating substrate(s), or insulating film(s) may comprise a conductive coating (e.g. in the regions that the electrodes do not contact) to prevent charge build up due to ion strikes. For example, a resistive layer may be provide between the electrodes, so as to avoid the insulating material becoming electrically charged.

PCB as used herein may refer to a component containing conductive tracks, pads and other features etched from, printed on, or deposited on one or more sheet layers of material laminated onto and/or between sheet layers of a non-conductive substrate.

It may be desired to increase the ion confining force as a function of distance in the first direction, e.g. so that the amplitude of oscillation of the ions (e.g. micro-motion) orthogonal to the first direction is (gradually) reduced as a function of distance along the ion guide portion.

For example, the DC voltage supplies may be configured to apply different DC voltages to the DC electrodes so as to form a voltage gradient in the first direction that increases the ion confining force as a function of distance in the first direction.

This may be achieved by connecting the DC electrodes aligned in the first direction using resistive dividers.

For the avoidance of doubt, said function of distance in the first direction is the distance away from the ion entrance to the ion guide portion.

The DC electrodes may be arranged in rows that are spaced apart in at least one dimension orthogonal to the first direction for confining the ions between the rows, and the DC electrodes may be spaced apart in said at least one dimension by an amount that decreases as a function of distance in the first direction.

The spacing between the DC electrodes in said at least one dimension may decrease as a function of distance in the first direction from the ion entrance at a first end of the ion guide portion to a downstream portion.

The spacing between the DC electrodes in said at least one dimension may be maintained constant from the downstream portion at least part of the distance to a second end of the ion guide portion.

The at least one dimension may be the dimension (Y-dimension) orthogonal to both the first direction (Z-dimension) and the second direction (X-dimension).

The pulsed ion accelerator may be configured to control the DC voltage supplies to switch off at least some of said DC potentials applied to the DC electrodes and then subsequently control the pulsed voltage supply to apply the pulsed voltage for pulsing ions out of the ion accelerator; and/or the pulsed ion accelerator may be configured to control the DC voltage supplies to progressively reduce the amplitudes of the DC potentials applied to the DC electrodes with time, and then subsequently control the pulsed voltage supply to apply the pulsed voltage for pulsing ions out of the ion accelerator.

The ion accelerator may repeatedly (and optionally periodically) pulse ions out, and prior to each pulse may switch off the DC potentials applied to the DC electrodes. Alternatively, or additionally, the ion accelerator may repeatedly (and optionally periodically) pulse ions out, and prior to each pulse may progressively reduce the amplitudes of the DC potentials applied to the DC electrodes with time.

The above embodiments may reduce the micro-motion of the ions within the confined ion beam before pulsed ejection.

The pulsed ion accelerator may comprise pulsed electrodes spaced apart in the second direction (X-dimension) on opposite sides of the ion guide portion, at least one of which is connected to the pulsed voltage supply for pulsing ions in the second direction (X-dimension).

The pair of pulses electrodes may comprise at least one push electrode connected to the pulsed voltage supply for pulsing ions away from the at least one push electrode, out of the ion guide portion, and out of the ion accelerator; and/or at least one puller electrode connected to the pulsed voltage supply for pulsing ions towards the at least one puller electrode, out of the ion guide portion, and out of the ion accelerator.

The at least one puller electrode may have a slit therein, or may be formed from spaced apart electrodes, so as to allow the pulsed ions to pass therethrough.

The pulsed ion accelerator may comprise electrodes spaced apart in the second direction (X-dimension) on opposite sides of the ion guide portion; wherein these electrodes are spaced apart in said second direction (X-dimension) by an amount that decreases as a function of distance in the first direction.

These electrodes may be the pulsed electrodes described above.

The spacing between the electrodes in said second direction (X-dimension) may decrease as a function of distance in the first direction from the ion entrance at a first end of the ion guide portion to a downstream portion. The spacing between the electrodes in said second direction (X-dimension) may be maintained constant from the downstream portion at least part of the distance to a second end of the ion guide portion.

The pulsed ion accelerator may comprise electrodes spaced apart in the second direction (X-dimension) on opposite sides of the ion guide portion; wherein the average DC potential of said DC potentials may be negative relative to said electrodes spaced apart in the second direction so as to form a quadrupolar field that compresses the ions in the second direction (X-dimension).

Said electrodes spaced apart in the second direction may be the pulsed electrodes described above.

The pulsed ion accelerator may comprise electrodes and voltage supplies forming a DC ion acceleration field arranged downstream of the ion guide portion, in the second direction (X-dimension).

The present invention also provides a mass spectrometer comprising: a time-of-flight mass analyser or electrostatic ion trap having the pulsed ion accelerator as described hereinabove, and electrodes arranged and configured to reflect or turn ions.

The mass spectrometer may comprise: a multi-pass time-of-flight mass analyser or electrostatic ion trap having the pulsed ion accelerator as described hereinabove, and electrodes arranged and configured so as to provide an ion drift region that is elongated in a drift direction (z-dimension) and to reflect or turn ions multiple times in an oscillating dimension (x-dimension) that is orthogonal to the drift direction.

The drift direction (z-dimension) may corresponds to said first direction and/or the oscillating dimension (x-dimension) may correspond to said second direction; or said first direction may be tilted at an acute angle to the drift direction (z-dimension).

The first direction and drift direction (z-dimension) may be arranged at a small angle to each other for isochronous steering of ion packets. The steering angles may be adjusted for aligning the ion packets time front with the drift direction (z-dimension).

For the avoidance of doubt, the time front of the ions may be considered to be a leading edge/area of ions in the ion packet having the same mass to charge ratio (and which may have the mean average energy).

The spectrometer may be configured to spatially focus the ion packets in the drift direction (z-dimension) downstream of the pulsed ion accelerator.

The spatial focusing may comprise: (i) spatial focusing or steering of the ions by a field of a trans-axial lens/wedge, optionally complimented with curved electrodes in the pulsed extraction region of the pulsed ion accelerator; (ii) spatial focusing and/or steering of the ions by multiple segments of deflecting fields, e.g. forming a Fresnel lens/deflector; (iii) by arranging a negative spatial-temporal correlation of the ion beam within said ion guide portion at ion beam injection into said ion guide portion; (iv) by arranging a first direction dependent deceleration of the ion beam within said ion guide portion.

The spectrometer may be configured to pulse the ion packets so as to be displaced in the dimension (Y-dimension) orthogonal to the drift direction (Z-dimension) and the oscillating dimension (X-dimension).

This may enable the ions to be displaced onto an isochronous surface of mean ion trajectory within the fields of the isochronous electrostatic analyzer.

The multi-pass time-of-flight mass analyser may be a multi-reflecting time of flight mass analyser having two ion mirrors that are elongated in the drift direction (z-dimension) and configured to reflect ions multiple times in the oscillation dimension (x-dimension), wherein the pulsed ion accelerator is arranged to receive ions and accelerate them into one of the ion mirrors. Alternatively, the multi-pass time-of-flight mass analyser may be a multi-turn time of flight mass analyser having at least two electric sectors configured to turn ions multiple times in the oscillation dimension (x-dimension), wherein the pulsed ion accelerator is arranged to receive ions and accelerate them into one of the sectors.

Where the mass analyser is a multi-reflecting time of flight mass analyser, the mirrors may be gridless mirrors.

Each mirror may be elongated in the drift direction and may be parallel to the drift dimension.

It is alternatively contemplated that the multi-pass time-of-flight mass analyser or electrostatic trap may have one or more ion mirror and one or more sector arranged such that ions are reflected multiple times by the one or more ion mirror and turned multiple times by the one or more sector, in the oscillation dimension.

The spectrometer may comprise an ion deflector located downstream of said pulsed ion accelerator, and that is configured to back-steer the average ion trajectory of the ions, in the drift direction, thereby tilting the angle of the time front of the ions received by the ion deflector.

The average ion trajectory of the ions travelling through the ion deflector may have a major velocity component in the oscillation dimension (x-dimension) and a minor velocity component in the drift direction. The ion deflector back-steers the average ion trajectory of the ions passing therethrough by reducing the velocity component of the ions in the drift direction. The ions may therefore continue to travel in the same drift direction upon entering and leaving the ion deflector, but with the ions leaving the ion deflector having a reduced velocity in the drift direction. This enables the ions to oscillate a relatively high number of times in the oscillation dimension, for a given length in the drift direction, thus providing a relatively high resolution.

The ion deflector may be configured to generate a substantially quadratic potential profile in the drift direction.

The pulsed ion accelerator and ion deflector may tilt the time front so that it is aligned with the ion receiving surface of the ion detector and/or to be parallel to the drift direction (z-dimension).

The mass analyser or electrostatic trap may be an isochronous and/or gridless mass analyser or an electrostatic trap.

The mass analyser or electrostatic trap may be configured to form an electrostatic field in a plane defined by the oscillation dimension and the dimension orthogonal to both the oscillation dimension and drift direction (i.e. the XY-plane).

This two-dimensional field may have a zero or negligible electric field component in the drift direction (in the ion passage region). This two-dimensional field may provide isochronous repetitive multi-pass ion motion along a mean ion trajectory within the XY plane.

The energy of the ions received at the pulsed ion accelerator and the average back steering angle of the ion deflector may be configured so as to direct ions to an ion detector after a pre-selected number of ion passes (i.e. reflections or turns).

The spectrometer may comprise an ion source. The ion source may generate an substantially continuous ion beam or ion packets.

The pulsed ion accelerator may receive a substantially continuous ion beam or packets of ions, and may pulse out ion packets.

The pulsed ion accelerator may be a gridless orthogonal accelerator.

The drift direction may be linear (i.e. a dimension) or it may be curved, e.g. to form a cylindrical or elliptical drift region.

The mass analyser or ion trap may have a dimension in the drift direction of: ≤1 m; ≤0.9 m; ≤0.8 m; ≤0.7 m; ≤0.6 m; or ≤0.5 m. The mass analyser or trap may have the same or smaller size in the oscillation dimension and/or the dimension orthogonal to the drift direction and oscillation dimension.

The mass analyser or ion trap may provide an ion flight path length of: between 55 and 15 m; between 6 and 14 m; between 7 and 13 m; or between 8 and 12 m.

The mass analyser or ion trap may provide an ion flight path length of: ≤20 m; ≤15 m; ≤14 m; ≤13 m; ≤12 m; or ≤11 m. Additionally, or alternatively, the mass analyser or ion trap may provide an ion flight path length of: ≥5 m; ≥6 m; ≥7 m; ≥8 m; ≥9 m; or ≥10 m. Any ranges from the above two lists may be combined where not mutually exclusive.

The mass analyser or ion trap may be configured to reflect or turn the ions N times in the oscillation dimension, wherein N is: ≥5; ≥6; ≥7; ≥8; ≥9; ≥10; ≥11; ≥12; ≥13; ≥14; ≥15; ≥16; ≥17; ≥18; ≥19; or ≥20. The mass analyser or ion trap may be configured to reflect or turn the ions N times in the oscillation dimension, wherein N is: ≤20; ≤19; ≤18; ≤17; ≤16; ≤15; ≤14; ≤13; ≤12; or ≤11. Any ranges from the above two lists may be combined where not mutually exclusive.

The spectrometer may have a resolution of: ≥30,000; ≥40,000; ≥50,000; ≥60,000; ≥70,000; or ≥80,000.

The spectrometer may be configured such that the pulsed ion accelerator receives ions having a kinetic energy of: ≥20 eV; ≥30 eV; ≥40 eV; ≥50 eV; ≥60 eV; between 20 and 60 eV; or between 30 and 50 eV. Such ion energies may reduce angular spread of the ions and cause the ions to bypass the rims of the orthogonal accelerator.

The spectrometer may comprise an ion detector.

The detector may be an image current detector configured such that ions passing near to it induce an electrical current in it. For example, the spectrometer may be configured to oscillate ions in the oscillation dimension proximate to the detector, inducing a current in the detector, and the spectrometer may be configured to determine the mass to charge ratios of these ions from the frequencies of their oscillations (e.g. using Fourier transform technology). Such techniques may be used in the electrostatic ion trap embodiments.

Alternatively, the ion detector may be an impact ion detector that detects ions impacting on a detector surface. The detector surface may be parallel to the drift dimension.

The ion detector may be arranged between the ion mirrors or sectors, e.g. midway between (in the oscillation dimension) opposing ion mirrors or sectors.

The spectrometer may comprise an ion source and a lens system between the ion source and pulsed ion accelerator for telescopically expanding the ion beam from the ion source.

The lens system may form a substantially parallel ion beam along the first direction (Z-direction). The telescopic expansion may be used to optimise phase balancing of the ion beam within the ion guide portion, e.g. where the initial angular divergence and width of the ion beam provide for about equal impact onto the thickness of the confined ion beam.

The spectrometer may comprise an ion source in a first vacuum chamber and the pulsed ion accelerator in a second vacuum chamber, wherein the vacuum chambers are separated by a wall and are configured to be differentially pumped, and wherein the ion guide portion protrudes from the second vacuum chamber through an aperture in the wall and into the first vacuum chamber.

The present invention also provides a method of mass spectrometry comprising: providing a pulsed ion accelerator or mass spectrometer as described hereinabove; receiving ions in said ion guide portion of the pulsed ion accelerator; applying different DC potentials to different ones of said DC electrodes such ions travelling through the ion guide portion along said first direction experience an ion confining force in at least one dimension (X- or Y-dimension) orthogonal to the first direction; and then applying a pulsed voltage to at least one of the electrodes of the pulsed ion accelerator so as to pulse ions out of the ion accelerator in the second direction (X-dimension).

Proposed herein is a spatially alternated DC quadrupolar field within a pulsed accelerator or converter for indefinite confinement of an ion beam without limits on ion mass to charge ratio and enabling for instant switching off of the confining fields. The accelerator may be further improved with "balancing" of ion beam spatial and angular spreads by entrance ion optics for minimizing the phase space of the confined ion beam. The accelerator may further be improved by forming "adiabatic" spatial entrance and temporal exit conditions.

Embodiments comprise PCB variants for implementing the guide, gently curved guides and guides protruding through differentially pumped walls.

The coupling of elongated pulsed converters to MPTOF and E-traps may be enhanced by introducing embodiments for bypassing the converter and by introducing multiple embodiments for isochronous spatial focusing of elongated ion packets.

Embodiments of the present invention provide a method of mass spectrometric analysis within isochronous electrostatic fields, comprising the following steps:

(a) forming electrostatic quadrupolar field in the XY-plane, which is spatially alternated along the orthogonal Z-direction;

(b) passing an ion beam along the Z-direction;

(b) pulsed accelerating of the moving ions in the X-direction, thus forming ion packets;

Preferably, the method may further comprise a step of forming a constant per Z-direction quadrupolar electrostatic field in said XY-plane to produce an additional ion beam confinement in the X-direction.

Preferably, the step of pulsed orthogonal acceleration in the X-direction may further comprise a step of switching off of said quadrupolar confining fields to a different field being uniform in the Z-direction for minimizing time, and/or angular aberrations, and/or energy spread of said extracted ion packets.

Preferably, the method may further comprise a step of arranging adiabatic conditions at ion beam entrance and the ion packet exit into and from said quadrupolar fields comprising at least one step of the group: (i) arranging spatial gradual in space rise of said quadrupolar confining field; and (ii) arranging gradual in time switching of said quadrupolar field; wherein gradual means that the moving ions sense the quadrupolar field rise and fall within several cycles of the quadrupolar field alternations.

Preferably, said Z-axis is generally curved.

Preferably, said quadrupolar confining field is arranged to protrude through walls separating differentially pumped stages of an ion source generating said ion beam.

Preferably, said fields of isochronous electrostatic analyzer may comprise either isochronous fields of gridless ion mirrors or isochronous fields of electrostatic sectors; and wherein said fields may be arranged for either time-of-flight analysis or for ion trapping with measuring frequency of their oscillations within said isochronous electrostatic fields.

Preferably, said field of electrostatic analyzer may be two-dimensional and substantially extended along a tilted Z'-axis; wherein axes Z and Z' may be arranged as mall angle for isochronous steering of ion packets; wherein said steering angles are adjusted for aligning the ion packets time front with the axis Z'.

Preferably, the method may further comprise a step of ion packet spatial focusing in the Z-direction past said step of ion pulsed ejection; wherein said spatial focusing may comprise one step of the group: (i) spatial focusing or steering by a field of trans-axial lens/wedge, complimented with curved electrodes in the pulsed extraction region; (ii) spatial focusing and/or steering by multiple segments of deflecting fields, forming a Fresnel lens/deflector; (iii) by arranging a negative spatial-temporal correlation of ion beam within said ion storage gap at ion beam injection into said storage gap; (iv) by arranging a Z-dependent deceleration of ion beam within said ion guide.

Preferably, the method may further comprise a step of pulsed displacing of said ion packets in the Y-direction to bring said ion packets onto an isochronous surface of mean ion trajectory within said fields of isochronous electrostatic analyzers.

Preferably, the timing and the duration of said pulsed ion packet displacement in the Y-direction is arranged for reducing the mass range of the ion packet and wherein the period of said pulsed acceleration is arranged shorter compared to flight time of the heaviest ion species in said isochronous analyzer.

Embodiments of the present invention provide a mass spectrometer, comprising:

(a) An ion source, generating an ion beam along a first drift Z-direction at some initial energy;

(b) An orthogonal accelerator, admitting said ion beam into a storage gap, pulsed accelerating a portion of said ion beam in the second orthogonal X-direction, thus forming ion packets with a smaller velocity component in the Z-direction and with the major velocity component in the X-direction;

(c) An electrostatic multi-pass (multi-reflecting or multi-turn) mass analyzer, built of ion mirrors or electrostatic sectors, substantially elongated in said Z-direction to form an electrostatic field in an XY-plane orthogonal to said Z-direction; said two-dimensional field provides for a field-free ion drift in the Z-direction towards a detector, and for an isochronous repetitive multi-pass ion motion within an isochronous mean ion trajectory surface—either symmetry s-XY plane of said ion mirrors or curved s-surface of electrostatic sectors;

(d) within said storage gap of said orthogonal accelerator, an ion guide composed of electrodes, symmetrically surrounding said ion beam; said electrodes are energized by at least two distinct DC potentials to form an electrostatic quadrupolar field in the XY-plane, which is spatially alternated along the Z-direction;

Preferably, said Z-axis may be generally curved.

Preferably, said ion guide may be arranged extended beyond said storage gap of said orthogonal accelerator.

Preferably, said ion guide may be arranged to protrude through walls of differentially pumped stages.

Preferably, said isochronous electrostatic analyzer may comprise either isochronous gridless ion mirrors or isochronous electrostatic sectors; and wherein said fields may be arranged for either time-of-flight analysis or for ion trapping with measuring frequency of their oscillations within said isochronous electrostatic fields.

Preferably, said electrostatic analyzer may form two-dimensional fields substantially extended along a Z'-axis; wherein axes Z and Z' may be arranged at small angle for isochronous steering of ion packets; wherein said steering angles may be adjusted for aligning the ion packets time front with the axis Z'.

Preferably, past said orthogonal accelerator, the spectrometer may further comprise one means for ion packet spatial focusing in the Z-direction of the group: (i) a trans-axial lens/wedge, complimented with curved electrodes in the pulsed extraction region; (ii) a Fresnel lens/deflector; (iii) pulsed or time variable signals applied upstream of said orthogonal accelerator for arranging a negative spatial-temporal correlation of ion beam within said ion storage gap; (iv) a Z-dependent voltage gradient within said guide for deceleration of said ion beam.

Preferably, past said orthogonal accelerator, the spectrometer may further comprise at least a pair of deflectors or sectors, placed immediately after said orthogonal accelerator for pulsed displacing of said ion packets in the Y-direction to bring said ion packets onto an isochronous surface of mean ion trajectory.

Embodiments improve the process of ion beam confinement within elongated OA; extend the mass range and remove the mass dependent and RF dependent effects at pulsed ejection; and improve coupling of elongated pulsed converters with MRTOF and E-trap mass spectrometers for higher sensitivities and duty cycles.

BRIEF DESCRIPTION OF THE DRAWINGS

Various embodiments will now be described, by way of example only, and with reference to the accompanying drawings in which.

DETAILED DESCRIPTION

Figure 1:
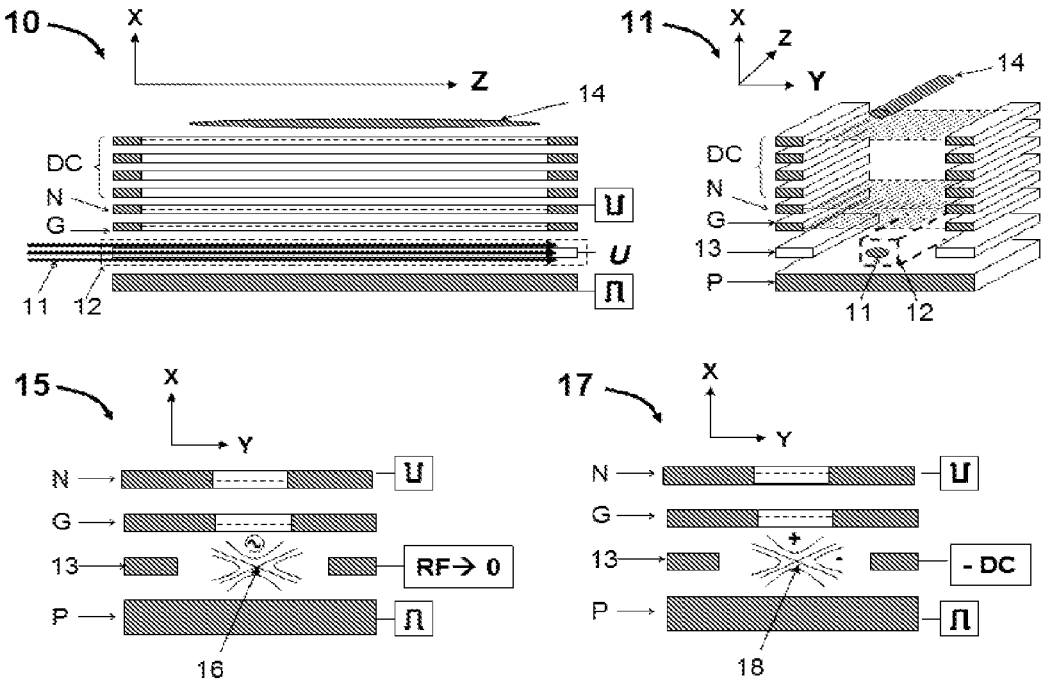
Fig.1 Prior Art
FIG. 1 shows prior art methods of ion beam spatial confinement within storage gaps of elongated orthogonal accelerators.

Referring to FIG. 1, prior art orthogonal accelerators (OA) 15 and 17 are shown in the XZ-view 10 and the XY-view 11. OA 15 employs a radio-frequency (RF) field for ion beam confinement, and OA 17 employs a DC field for ion beam confinement. Both OA 15 and 17 sequentially comprise: push electrode P; auxiliary confining electrodes 13; grounded mesh G; pull mesh N; and a set of electrodes for DC acceleration denoted DC with the mesh covered exit electrode.

Continuous ion beam 11 propagates along the Z-axis and enters the space between push P and mesh G electrodes. Within this space, confining electric field 12 is arranged with the aid of auxiliary electrodes 13, connected to some electric signal U, either RF (in device 15) or DC (in device 17). Periodic pulses are applied to electrodes P and N to extract ion packets 14 out of continuous beam 11 for injection into a TOF MS mass analyser.

OA 15 of prior art U.S. Pat. No. 5,763,878 or 8,373,120, proposes the spatial confinement of the ion beam 11 by radiofrequency RF radial field 16, generated by applying an RF signal to side electrodes 13. Optionally, the RF field is switched off before ion extraction pulses are applied (to P and N). Both the effective potential well of the RF field and the micro-oscillations of the ions depend on ion mass to charge ratio m/z=μ. Parameters of the ion beam 11 and of pulsed ion packets 14 depend on μ, on the RF phase at switching off, and on the time delay to pulses. In addition, OA 15 has two major drawbacks: (a) the RF field limits the transmitted mass range and (b) the extraction pulses induce strong oscillations onto resonant RF generators, thus impeding transmission, resolution and mass accuracy of TOF MS.

OA 17, proposed in RU2013149761 employs a rectilinear electrostatic quadrupolar field 18, formed by applying a negative DC potential to electrodes 13. A weak electrostatic quadrupolar field focuses and confines the ion beam in the critical TOF X-direction (towards the ion mirror), while defocusing the ion beam in the non-critical transverse Y-direction. The method allows moderate elongation of ion packets 14, estimated to a length in the z-direction of about $L_Z \leq 50$ mm. Longer OAs suffer strong ion losses in the Y-direction.

Figure 2:
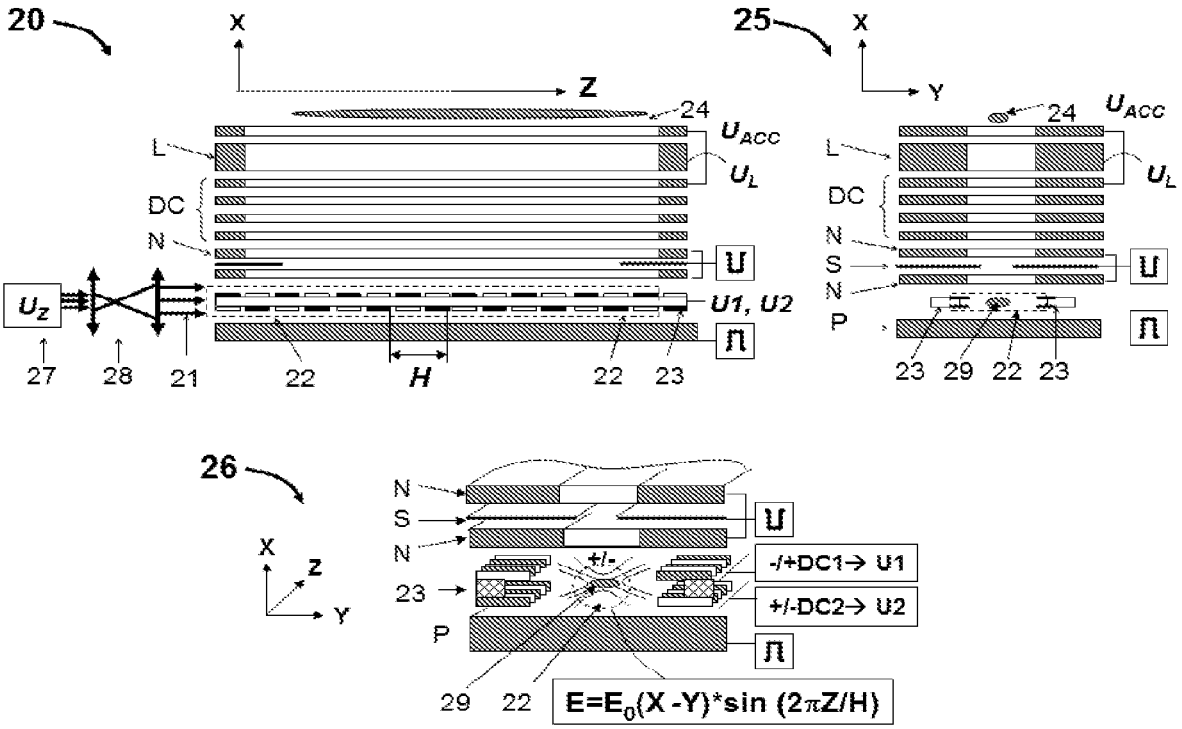
FIG. 2 illustrates method of an embodiment of the present invention of ion beam spatial confinement by spatially alternated electrostatic quadrupolar fields.

Referring to FIG. 2, there are shown XZ 20, XY 25 and XYZ 26 views of an embodiment 20 of the present invention, depicting a gridless orthogonal accelerator with novel means for ion beam spatial confinement. Embodiment 20 comprises: a push electrode P; a pair of pull electrodes N with a slit S in-between; a set of electrodes 23 forming an ion guide for spatial ion beam confinement, located in the space between plates P and N and connected to at least two DC signals DC1 and DC2; a DC acceleration stage DC; and a lens L for terminating DC field at nearly zero ion packet divergence in the XY-plane. All electrodes of the OA may be aligned with the drift Z-axis. The OA 20 may be preceded by an ion source 27 generating an ion beam at specific energy per charge UZ and by a lens system 28.

In operation, downstream of ion source 27, lens system 28 may expand the ion beam telescopically and form a nearly parallel ion beam 21 along the Z-axis. The telescopic expansion is preferably used to optimize so-called phase balancing of the ion beam 21 within ion guide 23, where initial angular divergence and width of the ion beam 21 provide for about equal impact onto thickness of the confined ion beam 29.

Ion beam 21 enters the P-N gap and becomes spatially confined in the region 22 by a set of alternating electrodes with distinct DC voltages DC1 and DC2, generating a spatially alternating quadrupolar DC field E(X,Y), approximated at the field axis by a transverse field distribution:

$$E(X,Y)=E_0*(X-Y)/R*\sin(2\pi Z/H) \quad \text{(Eq.1)}$$

where E, Y and Z are the dimensions of the ion guide; H is spatial period of quadrupolar field alternation, and R is the characteristic field radius.

For ions having mass to charge ratio μ=m/z at specific axial (along Z-axis) energy $U_Z$, the axial velocity is $V_Z=(2U_Z/\mu)^{0.5}$. The spatial alternation of the quadrupolar DC field is sensed by ions moving through the DC field as if a periodic RF signal was being applied, which is known to radially confine ions to the field axis. The frequency of the sensed RF field $F=H/V_Z$ is inversely proportional to $\mu_{0.5}$. Then the effective potential well D(r) of the sensed RF field depends on the ion radial position r (where $r^2=X^2+Y^2$). It is important to note that D(r) is independent of the ion mass to charge ratio μ:

$$D(r)=E_0^2*(r^2/R^2)/\mu(2\pi F)^2=[E_0^2H^2/2\pi U_Z]*(r^2/R^2) \quad \text{(Eq. 2)}$$

[For reference: $D(r)=E_0^2*(r^2/R^2)/\mu(2\pi F)^2=E_0^2*(r^2/R^2)/\mu V_Z^2(2\pi/H)^2$]

Thus, the novel electrostatic ion guide equally confines ions of all mass to charge ratios μ, e.g. assuming they have similar axial and radial energies.

The alternating quadrupolar field indefinitely (per Z) confines ion beam 29 in both transverse directions (i.e. X and Y directions), producing a spatially tight ion beam within substantially elongated orthogonal accelerators or other pulsed converters. Electrical pulses may be applied to electrodes P and N to convert the continuous ion beam 29 into pulsed ion packets 24 by orthogonal pulsed extraction. Preferably, voltages DC1 and DC2 are switched to zero or to different setting U1 and U2 at the time of the pulsed ion ejection so as to improve the electric field distribution at ion ejection.

The novel electrostatic quadrupolar ion guide 23 provides for indefinite ion beam confinement. Relative to the RF confinement of prior art device 15 (see FIG. 1), the novel electrostatic confinement provides multiple advantages: it is mass independent; it does not require resonant RF circuits and can be readily switched on and off; the strength and shape of the transverse confining field can be readily varied along the guide length (i.e. along the z-direction); it can provide an axial gradient, slight wedge or curvatures of the confining field without constructing complex RF circuits.

Figure 3:
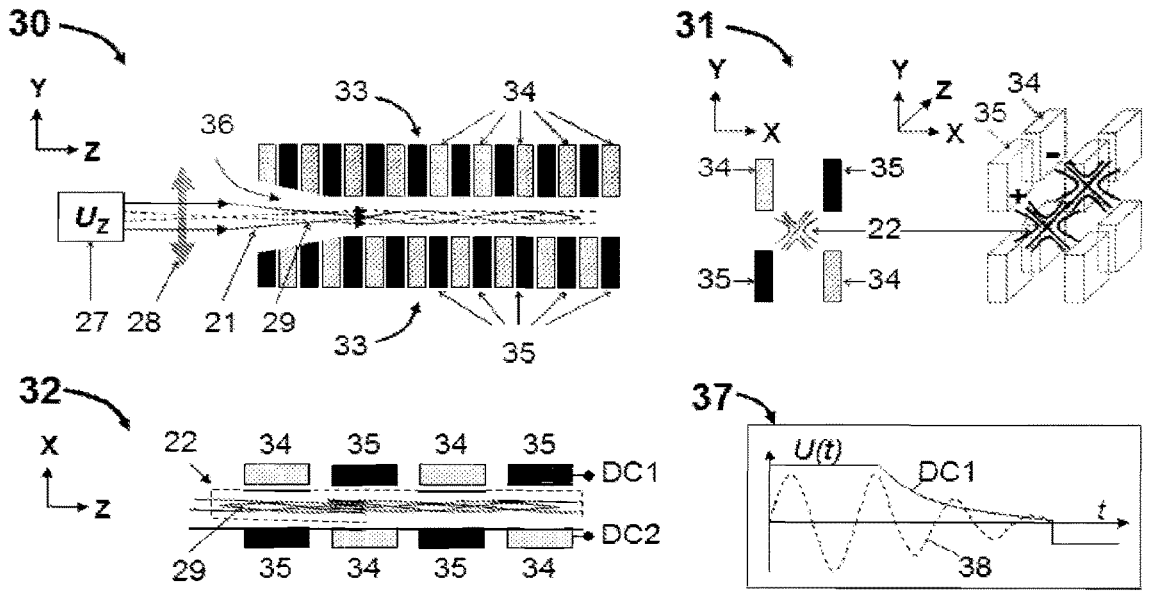
FIG. 3 shows electrode details and improved boundaries of the quadrupolar field of FIG. 2

Referring to FIG. 3, the electrode structure of ion guide 23 for quadrupolar electrostatic ion confinement within OA 20 (of FIG. 2) is illustrated in multiple views 30, 31, and 32 of embodiment 30. The ion guide 23 in embodiment 30 comprises four rows 33 (in the z-direction) of electrodes 34,35. Electric potential DC1 is applied to alternating electrodes 35 in each row, as shown by the darker coloured electrodes 35. Electric potential DC2 is applied to alternating electrodes 34 in each row, as shown by the lighter coloured electrodes 34. Electrodes 34 and 35 are interleaved in the z-direction.

In operation, as best seen in 3D view 31, electrodes 34 and 35 form a local quadrupolar electrostatic field 22 in every XY-cross section. The polarity of the quadrupolar field changes when shifting in the Z-direction. Ion beam 21 at specific mean energy $U_Z$ may be formed in an ion source 27, and may be shaped by lens 28. Ion beam 21 enters quadrupolar field 22 along the Z-axis. From this point the ion beam is denoted by number 29. Because of the periodically spatially alternating DC quadrupolar field, ions moving along the Z-axis sense a quadrupolar field that periodically changes with time, which is known to provide radial ion confinement towards the field axis (in a similar manner to an RF field acting on a static ion). The ion beam stays spatially confined in the x-y plane at limited angular divergence, without limits on the Z-length. The beam 29 is refocused multiple times by the quadratic field, eventually mixing ions within a limited phase space.

Preferably, lens 28 reshapes the phase space of the ion beam 21 entering the ion guide 23 for optimal balance between width and divergence of the confined ion beam 29. Preferably, the average potential (DC1+DC2)/2 is slightly negative relative to P and N electrodes to form a combination of the alternating quadrupolar field 22 with a constant per Z quadrupolar field, thus providing stronger compression of the ion beam 29 in the X-direction Vs Y-direction.

Embodiment 30 is further improved by arranging so-called "adiabatic entrance" 36 and "adiabatic exit" 37 conditions for ion beam 29.

For adiabatic entrance 36, there is arranged a smooth spatial rise of quadrupolar DC field, spread for at least 2-3 spatial periods of the DC field alternation. The smooth rise of the quadrupolar field may be arranged either by the illustrated Y-spreading of ion guide 23 electrodes, and/or by narrowing of the storage gap between electrodes N and P in the X-direction, and/or by arranging a gradient of DC voltages in the Z-direction, e.g. by resistive dividers.

Ions staying on axis of the guide 23 experience zero transverse field and have zero micro-motion, however, radially distant ions do not. For "adiabatic exit" 37 of radially distant ions at pulsed extraction of ion packets, embodiments of the invention initially maintain the DC1 and DC2 amplitudes constant and then switch the amplitudes to gradually decrease with time, e.g. as shown for DC1 in graph 37. The switching time may correspond to the time after the ion has passed through several DC alternations of the ion guide 23, as shown in plot 37 by time variation 38 of sensed quadrupolar field for some probe ion. This adiabatic switching reduces the energy of "micro-motion" of the ions within the confined ion beam 29 before pulsed ejection.

Figure 4:
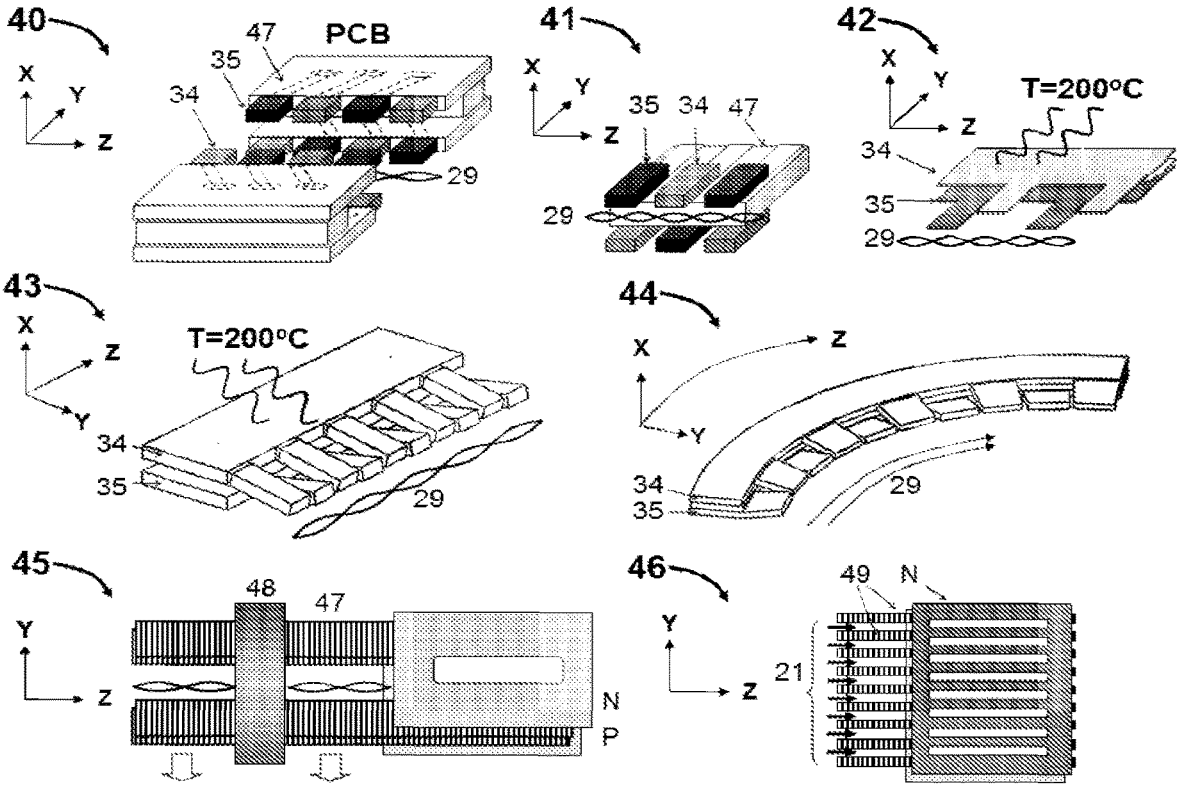
FIG. 4 shows construction principles to form the novel quadrupolar electrostatic guide within orthogonal accelerators.

Referring to FIG. 4, multiple construction principles 40 to 46 are proposed for forming confining means 23 within OA 20 of FIG. 2.

One particular embodiment 40 of the static quadrupolar guide 23 comprises a set of four parallel-aligned printed circuit boards (PCB) 47. Conductive pads on each board 47 form a row of alternated electrodes 34 and 35, distinct in the drawing by color coding as described above. Two DC potentials are interconnected with the conductive pads through displaced PCB vias, DC1 to electrodes 35 and DC2 to electrodes 34. Each side (in the Y-direction) of ion guide 40 is formed by a pair of boards 47, separated by an insulating plate, which is preferably also a PCB. Alternatively, the pair may be arranged within a single thick multilayer PCB for better precision. Since boards 47 are set distant from spatially confined ion beam 29, only limited care shall be used to shield insulating surfaces from stray ions. Since DC1 and DC2 potentials are expected to be in the range of several tens of Volts, the insulating ridges may be thin. Still, edge slots and edge conductive coatings are preferred for the ion guide robustness against the charging by stray ions.

Another particular embodiment 41 employs conductive electrodes 34 and 35 attached to both sides of a single PCB support 47. This is equivalent to one pair of boards 47 shown in embodiment 40. Another PCB support 47 with conductive electrodes 34 and 35 attached to both sides thereof would be required to form the ion guide 23 according to embodiment 41.

Yet another particular embodiment 42 comprises a row of alternating electrodes 34 and 35 constructed of two thin electrode plates that are spaced apart by a thin insulator such as a film, say, PTFE or Kapton film. Extending electrode ribs appear mutually displaced in the X-direction by the thickness of the insulator, which is expected to generate only minor Z-modulation of the quadrupolar field on the beam 29 axis. This is equivalent to one pair of boards 47 shown in embodiment 40. Another corresponding structure would be required to form the ion guide 23 according to embodiment 42.

Ion guides 42-44 are preferred for their compatibility with heating to approximately 150-200° C. for robust operation of the guide, for preventing built-up of insulating coatings or deposition of droplets from ESI sources.

Yet another particular embodiment 43 comprises machined (say by EDM) electrodes with bent extending electrode ribs. Optionally, ribs may be slightly bent in embodiment 42 as well.

Yet another particular embodiment 44 may have a curved Z axis, e.g. for reducing gas flux, for removal of charged droplets from ESI ion source, for removal of light and metastable particles from EI source, or for convenience of instrumental packaging. Initially turned electrodes may be machined by EDM.

Again referring to FIG. 4, in embodiment 45, electrostatic quadrupolar guides 40-44 may be further improved by seamless extending of the ion guides beyond the ion OA ion storage gap of electrodes N and P, e.g. so as to guide ions passed gaseous RF ion guides or passed ion optics, already forming a nearly parallel ion beam. Preferably, the ion guiding PCBs 47 (or set of conductive electrode 34 and 35) may pass through a wall 48 that separates differentially pumped stages of the spectrometer, with the pumping denoted by white arrows. The guide is expected to operate in the pressure range of, for example, up to 0.1-1 mTorr.

Beyond this pressure threshold, ions may start losing their kinetic energy and may be lost on the ion guide walls.

Again referring to FIG. 4, in embodiment 46 an array of ion guides 49 may be formed for operating with multiple ion sources, or multiple beam 21 fractions for increased throughput of mass spectral analyses with various TOF MS, or for mapping or imaging MRTOF, e.g. for use with the systems as described in WO2017091501, WO2017087470, and WO2017087456.

Figure 5:
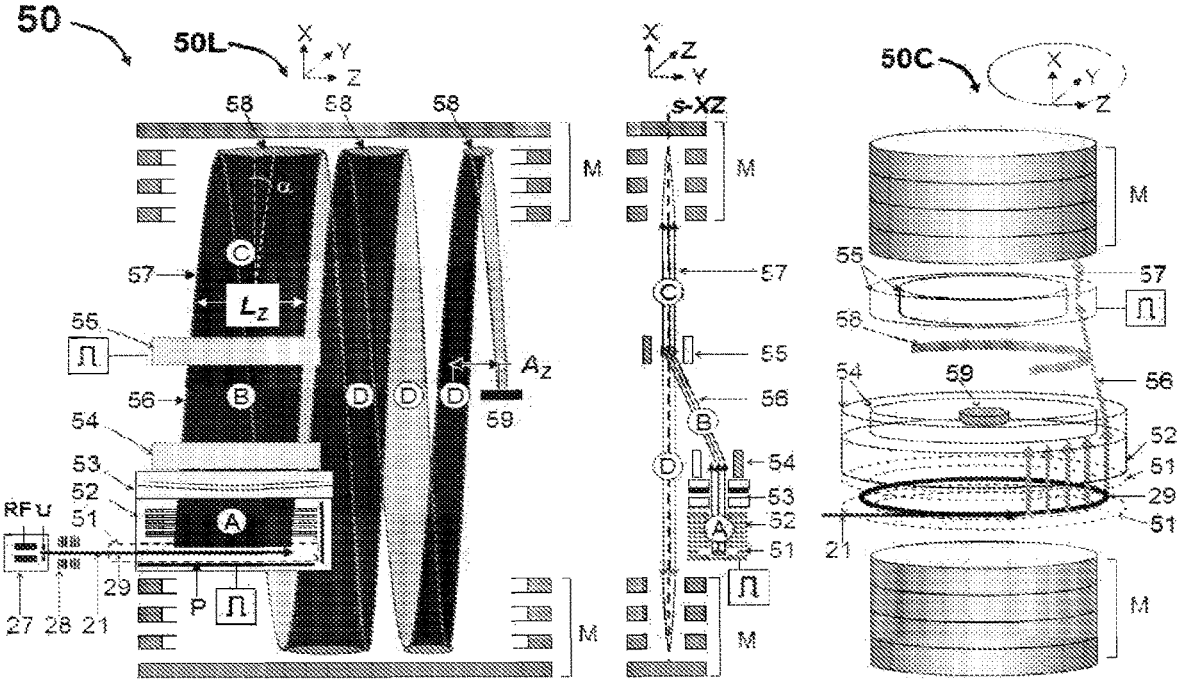
FIG. 5 shows an MRTOF embodiment employing an elongated accelerator, novel confinement means and a method of side bypassing of the elongated accelerator by ion packets.

Referring to FIG. 5, an OA-MRTOF embodiment 50 according to the present invention is shown in two variants: 50L—with linear Z-axis and 50C—with circular Z-axis, where functionally similar components are denoted with the same numbers between variants. Embodiment 50L comprises the novel electrostatic quadrupolar ion guide 51 for ion beam spatial confinement within a Z-elongated orthogonal accelerator 52. Embodiment 50 further comprises a pair of parallel gridless ion mirrors M, separated by a floated field-free drift space to form a multi-reflecting analyzer. Electrodes of OA 52 and of ion mirrors M are substantially elongated in the linear drift Z-direction to provide a two-dimensional electrostatic field in the X-Y plane, symmetric around s-XZ symmetry plane of isochronous trajectory surface and having zero field component in the Z-direction. Embodiment 50 further comprises: a continuous ion source 27; a lens system 28 to form a substantially parallel ion beam 21; an isochronous Z-focusing trans-axial lens 53; a set of dual Y-deflectors 54 and 55; and a TOF detector 59. Preferably, ion source 27 comprises an RF ion guide with pulsed exit gate, denoted by RF and by pulse symbol.

In operation, ion beam 21 is generated by source 27, formed by ion optics 28, and entering OA 51 along the Z-direction. Ion beam is transverse confined with guide 51, as described in FIGS. 2 to 4, becoming a confined portion 29 of the ion beam 21. Pulsed OA 52 extracts elongated ion packets 58. The mean ion trajectory of the ion packets 58 moves at a small inclination angle $\alpha$ to the x-axis, which is controlled by the $U_Z$ specific energy of ion beam 21 and by the acceleration voltage $U_X$ of the drift space.

Downstream of OA 51, elongated ion packets 58 are pulsed displaced in the Y direction by deflectors 54 and 55, thus bypassing the Y-displaced OA 52 and returning to the axis of ion mirrors M (best seen in the X-Y plane view). Ions are reflected between ion mirrors M in the X-direction within the s-XZ symmetry plane while drifting towards the detector 59 in the z-direction. Since ion packets are focused by trans-axial lens 53 in the Z-direction, they reach the face of detector 59 without hitting the rims of the detector. The duty cycle of the OA-MPTOF 50 may be improved, e.g. to above 50% from the several percent in conventional MPTOFs. The method becomes possible because of ion beam spatial confinement within the OA by the novel quadrupolar electrostatic ion guides. While embodiment 50 depicts multi-reflecting TOF MS (MR TOF), similar improvements are applicable to sector multi-turn TOF MS (MT TOF) and to singly reflecting TOF MS. The injection scheme of circular embodiment 50C may be useful for ion injection into cylindrical electrostatic traps.

Figure 6:
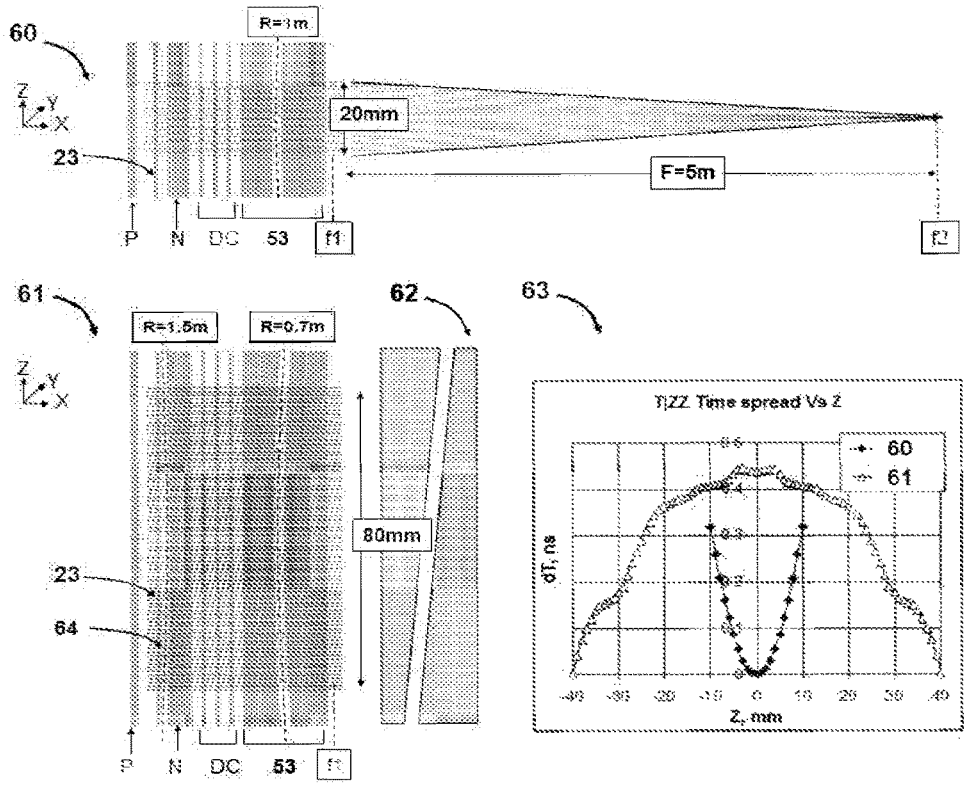
FIG. 6 shows embodiments of trans-axial lens/wedge, used for spatial focusing of elongated ion packets produced in MRTOF of FIG. 5.

Referring to FIG. 6, there are shown two embodiments 60 and 61 of Z-elongated gridless orthogonal accelerators (52 in FIG. 5) with quadrupolar electrostatic ion guide 23 (51 in FIG. 5). Both embodiments comprise push plate P, pull slit electrode N, slit electrodes DC for static acceleration, and a particular trans-axial lens 53. The trans-axial lens 53 may be a slit electrode (i.e. through which the ions may be pulsed) that is divided into two electrodes (in the x-direction) by a constant width gap that is curved in the X-Z plane at a curvature radius, e.g. R~1 m. Trans-axial lens 53 may be chosen for being slim in the Y-direction, which useful for ion packet Y-displacement as shown in FIG. 5. Embodiments 61 and 60 differ by using curvature of extraction field 64, here depicted by trans-axially curved pull electrode P. Embodiment 61 further comprises an optional trans-axial wedge 62 for ion steering. The wedge 62 may be combined with lens 53, which also may be achieved by tilting lens 53 relative to the Z axis.

The figures show iso-potential lines and ion trajectories. According to simulations, the trans-axial lens 53 serves for: (a) terminating the electrostatic DC accelerating field; (b) providing for ion spatial focusing in the XZ-plane to focal plane f2, in all cases simulated for F=5 m focal distance; and (c) providing substantial parallel beam in the XY-plane. Graph 63 shows time spreads introduced by spatial ion Z-focusing, simulated for 1000 amu ions. The trans-axial lens 53 alone in the embodiment 60 introduces positive T|ZZ aberration with additional time spread $dT(z)=T|ZZ*z^2$. The long focal distance F=5 m helps keeping the aberration moderate and allows focusing $L_Z$=20 mm long ion packets at dT(z)=0.3 ns amplitude.

Use of curved extraction field 64 in the embodiment 61 allows reverting the sign of the overall T|ZZ aberration, which may be further optimized for complete mutual compensation of T|ZZ aberrations. Without describing exhaustive details of ion optical simulation, the novel quadrupolar electrostatic ion guide 23 was found an important part of the Z-focusing trans-axial system: it retains the ion beam at limited width and diameter; it controls initial starting position at acceleration; it helps forming a T|ZZ compensating curvature of extracting pulsed field; it helps forming spatially focusing in Y-directions, while eliminating multiple time per Y aberrations.

Figure 7:
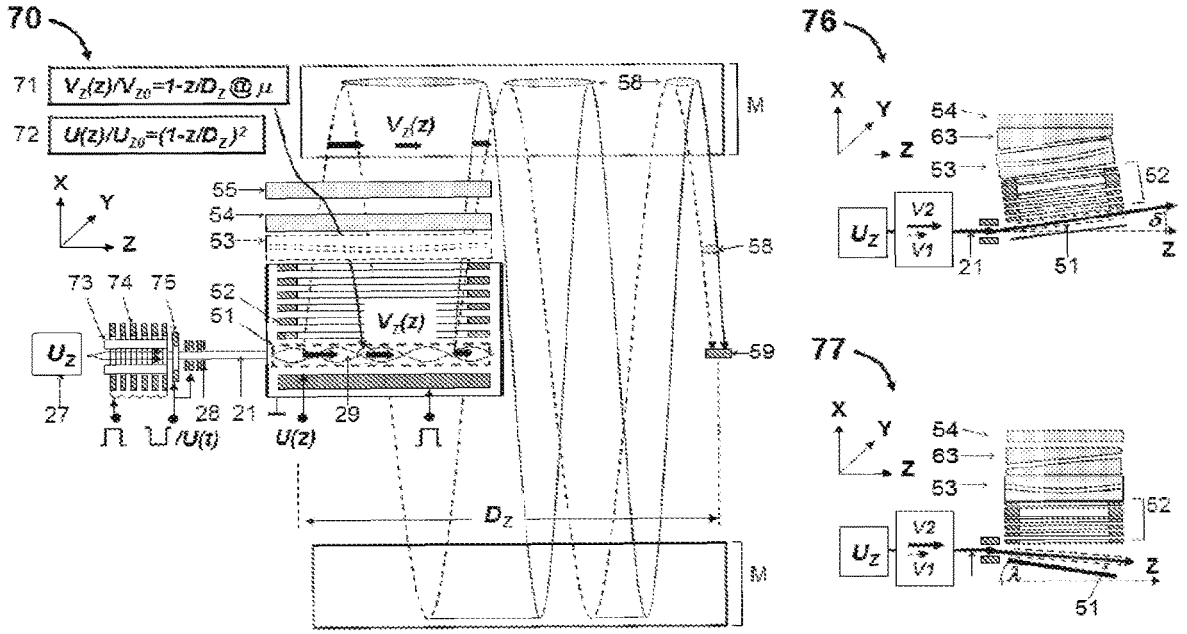
FIG. 7 illustrates methods of spatial ion packet focusing for MRTOF of FIG. 5, arranged by spatial-temporal correlation of ions in the novel confinement means used for spatial focusing of elongated ion packets.

Referring to FIG. 7, similar to FIG. 5, OA-MRT embodiment 70 of the present invention comprises: two parallel gridless ion mirrors M; an Z-elongated orthogonal accelerator OA 52, an optional trans-axial wedge/lens 53 for ion packet focusing; a dual Y-deflector 54 and 55 for the side OA bypassing by ion packets; and a detector 59. Ion beam 29 is retained within elongated OA 52 by any of described spatial confinement means 23/51.

Within ion packets 58, ions retain the $V_Z$ velocity of ion beam in the z-direction. If forming a negative correlation between $V_Z$ and z-coordinate in guide 51, ion packets 58 would be naturally focused onto detector 59.

Focusing condition 71 for a narrow range of mass to charge ratios $\mu=m/z$ may be achieved by pulsing of ion source or transfer optics, where $V_Z(z)$ is the ion axial velocity in guide 51, $V_{Z0}=V_Z(z=0)$, and $D_Z$ is the OA-detector distance:

$$V_Z(z)/V_{Z0}=1-z/D_z@\mu=m/z \quad \text{(eq. 3)}$$

For this purpose, the embodiment 70 may comprise one of the following means: an RF ion guide 73 with optional auxiliary electrodes 74 and an exit gate 75; a pulse generator; a time dependent U(t) signal generator.

In one method, an ion extracting pulse is applied to gate 75. The extracting pulse is known to generate an ion bunch with an energy spread in spite of gaseous dampening at about 10 mTorr gas pressures. Deeper starting ions will arrive to the OA 52 at later time, appear at smaller z within the guide 51, but will have larger $V_Z$. This produces ion packet compression 71 (eq. 3) at the detector 59. Though the method looks similar to the known Pulsar method, here ions are Z-compressed at the $D_Z$ distance of detector 59, rather than at the OA center of conventional TOF instruments. Note that the correlation 71 (eq. 3) occurs for narrow μ range only, controlled by the time delay between extraction and OA pulses. The embodiment is attractive for target analysis, where a narrow mass range is selected intentionally, while TOF data may be acquired at maximal OA frequency and at maximal dynamic range of the MRTOF detector.

In another method, to arrange the correlation 71 (eq. 3), either ion guide 73 and/or extraction electrode 75 and/or lens 28 are arranged into an elevator system, whose reference potential is time variable U(t). The effect of the time variable elevator is very similar to the above described bunching effect, though the elevator exit may be set closer to the OA entrance and may allow somewhat wider μ range. In both above methods, a nearly unity duty cycle of OA is expected for narrow μ range, thanks to the novel confinement means 51, permitting substantial OA elongation.

Yet in another method, to obtain focusing conditions for a wide mass range i.e. for all μ, the z-dependent specific energy U(z) (energy per charge) may be arranged with a resistive divider within confining means 51. For optimal ion packet compression onto detector 59, the U(z) shall satisfy condition 72, where $U_{Z0}=U(z=0)$:

$$U(z)/U_{Z0}=(1-z/D_Z)^2 \quad \text{(eq. 4)}$$

Ion beam 29 slows down in a Z-dependent axial potential distribution U(z) of confinement means 51. The desired z-focusing of ion packets is achieved for the entire ionic mass range, i.e. occurs for ions of all μ, while confinement means 51 provide mass independent radial confinement, as has been explained with equation Eq. 2. The method may be particularly attractive when using a "soft and prolonged" Pulsar mode, where open gate forms a prolonged quasi-continuous ion beams.

Again referring to FIG. 7, particular OA-MRTOF embodiments 76 and 77 of the present invention employ components and methods of embodiment 70. Embodiment 76 is improved by using higher energies of continuous ion beam 21, the OA 52 is tilted at angle δ to the z-axis and ions are back steered (in the z-direction) within a trans-axial lens/wedge 53 and 63. Embodiment 77 also allows using higher beam energies with back deflection with trans-axial lens/wedge 53 and 63, however, to compensate for time-front tilting and bending by TA wedge/lens 53 and 63, the OA 52 remains straight, while a wedge pulsed accelerating field is arranged for compensating tilting of ion packets time fronts, similar to a co-pending PCT application having the same filing date as this application and entitled "ACCELERATOR FOR MULTI-PASS MASS SPECTROMETERS" (and claiming from GB 1712613.7 filed 6 Aug. 2017). In both embodiments 76 and 77, ion confinement means 51 are useful for confining ion beam 29 within a precisely defined region of accelerating field.

Figure 8:
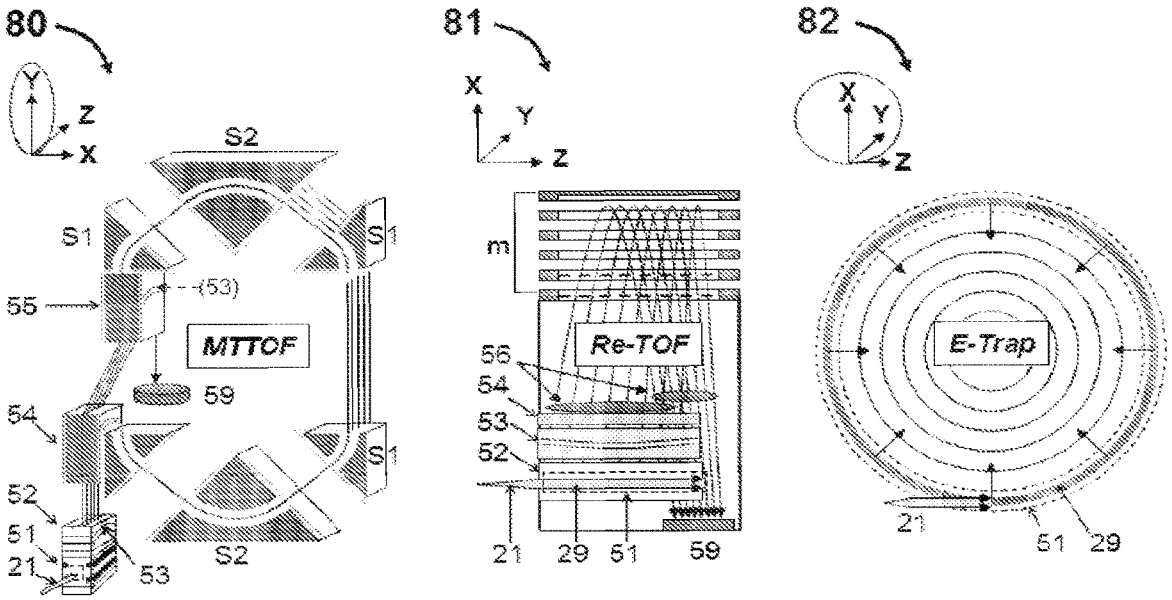

Referring to FIG. 8, improved accelerator 52 with ion confining means 51 by spatially alternated electrostatic quadrupolar field is applicable to a wider variety of isochronous electrostatic analyzers, exampled here by embodiment 80 of multi-turn sector TOF MS, embodiment 81 of singly reflecting TOF MS, and embodiment 82 of circular (also referred as "elliptical") electrostatic trap. All those embodiments comprise the same components of FIG. 5: continuous ion beam 21, quadrupolar electrostatic ion guide 51 for spatial confinement of ion beam 29, being a confined portion of beam 21, an orthogonal accelerator 52, a trans-axial wedge/lens 53, a deflector 54, and a detector 59.

Annotations

Coordinates and Times:

x,y,z—Cartesian coordinates;

X, Y, Z—directions, denoted as: X for time-of-flight, Z for drift, Y for transverse;

$Z_0$—initial width of ion packets in the drift direction;

ΔZ—full width of ion packet on the detector;

$D_X$ and $D_Z$—used height (e.g. cap-cap) and usable width of ion mirrors

L—overall flight path

N—number of ion reflections in mirror MRTOF or ion turns in sector MTTOF u—x-component of ion velocity;

w—z-component of ion velocity;

T—ion flight time through TOF MS from accelerator to the detector;

ΔT—time spread of ion packet at the detector;

Potentials and Fields:

U—potentials or specific energy per charge;

$U_Z$ and $\Delta U_Z$—specific energy of continuous ion beam and its spread;

$U_X$—acceleration potential for ion packets in TOF direction;

K and ΔK—ion energy in ion packets and its spread;

δ=ΔK/K—relative energy spread of ion packets;

E—x-component of accelerating field in the OA or in ion mirror around "turning" point;

μ=m/z—ions specific mass or mass-to-charge ratio;

Angles:

α—inclination angle of ion trajectory relative to X-axis;

Δα—angular divergence of ion packets;

γ—tilt angle of time front in ion packets relative to Z-axis

λ—tilt angle of "starting" equipotential to axis Z, where ions either start accelerating or are reflected within wedge fields of ion mirror θ—tilt angle of the entire ion mirror (usually, unintentional);

φ—steering angle of ion trajectories or rays in various devices;

Ψ—steering angle in deflectors

ϵ—spread in steering angle in conventional deflectors;

Aberration Coefficients

T|Z, T|ZZ, T|δ, T|δδ, etc;

indexes are defined within the text

Although the present invention has been describing with reference to preferred embodiments, it will be apparent to those skilled in the art that various modifications in form and detail may be made without departing from the scope of the present invention as set forth in the accompanying claims.

The invention claimed is:

1. A pulsed ion accelerator for a mass spectrometer comprising:

an ion guide portion having electrodes arranged to receive ions travelling along a first dimension, including a plurality of DC electrodes spaced along the first dimension;

DC voltage supplies configured to apply different DC potentials to different ones of said DC electrodes such that when ions travel through the ion guide portion along the first dimension they experience an ion confining force, generated by the DC potentials, in at least one dimension orthogonal to the first dimension; and a pulsed voltage supply configured to apply a pulsed voltage to at least one electrode for pulsing ions in a second dimension substantially orthogonal to the first dimension.

2. The pulsed ion accelerator of claim 1, wherein the ion guide portion comprises a first pair of opposing rows of said DC electrodes on opposing sides of the ion guide portion, wherein each row extends in the first dimension, and wherein the DC voltage supplies are configured to maintain at least some of the adjacent DC electrodes in each row at potentials having opposite polarities.

3. The pulsed ion accelerator of claim 2, wherein the ion guide portion comprises a second pair of opposing rows of said DC electrodes on opposing sides of the ion guide portion, wherein each row extends in the first dimension, and wherein the DC voltage supplies are configured to maintain at least some of the adjacent DC electrodes in each row at potentials having opposite polarities.

4. The pulsed ion accelerator of claim 1, wherein the DC voltage supplies are configured to maintain the DC electrodes at potentials so as to form an electrostatic quadrupolar field in a plane orthogonal to the first dimension, wherein the polarity of the quadrupolar field alternates as a function of distance along the first dimension.

5. The pulsed ion accelerator of claim 1, wherein the DC electrodes are arranged to form a quadrupole ion guide that is axially segmented in the first dimension, and wherein the DC voltage supplies are configured to maintain DC electrodes that are axially adjacent in the first dimension at opposite polarities, and DC electrodes that are adjacent in a direction orthogonal to the first dimension at opposite polarities.

6. The pulsed ion accelerator of claim 1, wherein the DC electrodes are arranged on one or more printed circuit board (PCB), insulating substrate, or insulating film.

7. The pulsed ion accelerator of claim 1, wherein the DC voltage supplies are configured to apply different DC voltages to the DC electrodes so as to form a voltage gradient in the first dimension that increases the ion confining force as a function of distance in the first dimension.

8. The pulsed ion accelerator of claim 1, wherein the DC electrodes are arranged in rows that are spaced apart in at least one dimension orthogonal to the first dimension for confining the ions between the rows, and wherein the DC electrodes are spaced apart in said at least one dimension by an amount that decreases as a function of distance in the first dimension.

9. The pulsed ion accelerator of claim 1, configured to control the DC voltage supplies to switch off at least some of said DC potentials applied to the DC electrodes and then subsequently control the pulsed voltage supply to apply the pulsed voltage for pulsing ions out of the ion accelerator; and/or wherein the pulsed ion accelerator is configured to control the DC voltage supplies to progressively reduce the amplitudes of the DC potentials applied to the DC electrodes with time, and then subsequently control the pulsed voltage supply to apply the pulsed voltage for pulsing ions out of the ion accelerator.

10. The pulsed ion accelerator of claim 1, comprising electrodes spaced apart in the second dimension on opposite sides of the ion guide portion; wherein these electrodes are spaced apart in said second dimension by an amount that decreases as a function of distance in the first dimension.

11. The pulsed ion accelerator of claim 1, comprising electrodes spaced apart in the second dimension on opposite sides of the ion guide portion; and wherein the average DC potential of said DC potentials is negative relative to said electrodes spaced apart in the second dimension so as to form a quadrupolar field that compresses the ions in the second dimension.

12. A mass spectrometer comprising:

a time-of-flight mass analyser or electrostatic ion trap having the pulsed ion accelerator of claim 1, and electrodes arranged and configured to reflect or turn ions.

13. The mass spectrometer of claim 12, comprising:

a multi-pass time-of-flight mass analyser or electrostatic ion trap having the pulsed ion accelerator and electrodes arranged and configured so as to provide an ion drift region that is elongated in a drift dimension and to reflect or turn ions multiple times in an oscillating dimension that is orthogonal to the drift dimension.

14. The spectrometer of claim 13, wherein:

(i) the multi-pass time-of-flight mass analyser is a multi-reflecting time of flight mass analyser having two ion mirrors that are elongated in the drift dimension and configured to reflect ions multiple times in the oscillation dimension, wherein the pulsed ion accelerator is arranged to receive ions and accelerate them into one of the ion mirrors; or (ii) the multi-pass time-of-flight mass analyser is a multi-turn time of flight mass analyser having at least two electric sectors configured to turn ions multiple times in the oscillation dimension, wherein the pulsed ion accelerator is arranged to receive ions and accelerate them into one of the sectors.

15. The spectrometer of claim 13, comprising an ion deflector located downstream of said pulsed ion accelerator, and that is configured to back-steer the average ion trajectory of the ions, in the drift dimension, thereby tilting the angle of the time front of the ions received by the ion deflector.

16. The spectrometer of claim 13, comprising an ion source and a lens system between the ion source and pulsed ion accelerator for telescopically expanding the ion beam from the ion source.

17. The spectrometer of claim 13, comprising an ion source in a first vacuum chamber and the pulsed ion accelerator in a second vacuum chamber, wherein the vacuum chambers are separated by a wall and are configured to be differentially pumped, and wherein the ion guide portion protrudes from the second vacuum chamber through an aperture in the wall and into the first vacuum chamber.

18. A method of mass spectrometric analysis within an isochronous electrostatic field, comprising the following step:

(a) forming electrostatic quadrupolar field in the XY-plane, which is spatially alternated along the orthogonal Z-direction;

(b) passing an ion beam along the Z-direction;

(c) pulsed accelerating of the moving ions in the X-direction, thus forming ion packets.

19. A mass spectrometer, comprising:

(a) An ion source, generating an ion beam along a first drift Z-direction at some initial energy;

(b) An orthogonal accelerator, admitting said ion beam into a storage gap, pulsed accelerating a portion of said ion beam in the second orthogonal X-direction, thus forming ion packets with a smaller velocity component in the Z-direction and with the major velocity component in the X-direction;

(c) An electrostatic multi-pass (multi-reflecting or multi-turn) mass analyzer, built of ion mirrors or electrostatic sectors, substantially elongated in said Z-direction to form an electrostatic field in an XY-plane orthogonal to said Z-direction; said two-dimensional field provides for a field-free ion drift in the Z-direction towards a detector, and for an isochronous repetitive multi-pass ion motion within an isochronous mean ion trajectory surface—either symmetry s-XY plane of said ion mirrors or curved s-surface of electrostatic sectors;

(d) within said storage gap of said orthogonal accelerator, an ion guide composed of electrodes, symmetrically surrounding said ion beam; said electrodes are energized by at least two distinct DC potentials to form an electrostatic quadrupolar field in the XY-plane, which is spatially alternated along the Z-direction.

* * * * *